US009250559B2

(12) United States Patent
Shikina

(10) Patent No.: US 9,250,559 B2
(45) Date of Patent: Feb. 2, 2016

(54) PRINTING APPARATUS

(71) Applicant: CANON KABUSHIKI KAISHA, Tokyo (JP)

(72) Inventor: Noriyuki Shikina, Hachioji (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/322,552

(22) Filed: Jul. 2, 2014

(65) Prior Publication Data

US 2015/0015657 A1 Jan. 15, 2015

(30) Foreign Application Priority Data

Jul. 10, 2013 (JP) ..... 2013-144677

(51) Int. Cl.
*G03G 15/04* (2006.01)

(52) U.S. Cl.
CPC ..... *G03G 15/04054* (2013.01)

(58) Field of Classification Search
CPC ..... G03G 15/043; G03G 15/04054; G03G 15/326
See application file for complete search history.

(56) References Cited

U.S. PATENT DOCUMENTS

| | | | | |
|---|---|---|---|---|
| 6,055,071 | A * | 4/2000 | Kuwata et al. | 358/501 |
| 7,884,785 | B2 * | 2/2011 | Yamashita | G09G 3/2074 345/76 |
| 2008/0062096 | A1 | 3/2008 | Yamashita et al. | 345/82 |
| 2010/0165067 | A1 * | 7/2010 | Nomura et al. | 347/241 |

FOREIGN PATENT DOCUMENTS

| | | |
|---|---|---|
| JP | H10-55890 | 2/1998 |
| JP | 2008-065200 | 3/2008 |
| JP | 2009-154420 | 7/2009 |

* cited by examiner

*Primary Examiner* — Sarah Al Hashimi
(74) *Attorney, Agent, or Firm* — Fitzpatrick, Cella, Harper & Scinto

(57) ABSTRACT

Provided is a printing apparatus including: a photosensitive drum; a substrate including multiple formable regions in each of which corresponding one of multiple light emitting elements is formable; and a lens array, in which the substrate is arranged in a manner that a longitudinal direction of the substrate is parallel to a rotary shaft of the photosensitive drum, in which the substrate includes m formable region rows, where m is an integer number equal to or greater than 2, each of the m formable region rows including n formable regions, where n is an integer number equal to or greater than 1, arranged in a line along the longitudinal direction of the substrate, and in which one of the multiple light emitting elements formed in any one of m formable regions that are located in a predetermined column of the m formable region rows is turned on.

13 Claims, 21 Drawing Sheets

PRINTING APPARATUS

BACKGROUND OF THE INVENTION

1. Field of the Invention

The present invention relates to a printing apparatus, and more particularly, to a printing apparatus that is used in an electrophotographic system such as a copying machine and a printer, and includes an optical head having a light emitting element array.

2. Description of the Related Art

As an example of printing apparatus employing an electrophotographic system, there is given a printing apparatus including an exposure head including a light source which has an array of light emitting elements such as light emitting diodes. When the light source having the array of light emitting elements is used in the exposure head, the exposure head itself is downsized. Thus, quietness of the printing apparatus can be easily achieved. As an example of using the light emitting elements such as light emitting diodes as the light source of the exposure head as a component of the printing apparatus, there is given a light emitting element array disclosed in Japanese Patent Application Laid-Open No. H10-55890. The light emitting element array disclosed in Japanese Patent Application Laid-Open No. H10-55890 is manufactured by forming multiple organic EL elements collectively on an insulating substrate such as a glass substrate. Further, in Japanese Patent Application Laid-Open No. H10-55890, light beams output from the light emitting element array are converged with a converging rod lens array. The converged light beams are radiated onto a photosensitive drum so as to form a predetermined image.

However, the single-row light emitting element array disclosed in Japanese Patent Application Laid-Open No. H10-55890 has a problem in that the light emitting element array as a whole is treated as a defective product in a case where any single one of the light emitting elements of the array becomes defective. This is because, when printing is performed with the light emitting element array including the defective element, the defective element causes streak-like image defects on a printed material. The streak-like image defects are significantly conspicuous on the printed material, which are quite unacceptable to users. However, when a defect of even single one of the light emitting elements of the array cannot be accepted, there are problems of a decrease in manufacture yield and an increase in manufacturing cost of the light emitting element array.

As solutions to the above-mentioned problems, there have been proposed a method disclosed in Japanese Patent Application Laid-Open No. 2009-154420, and a method disclosed in Japanese Patent Application Laid-Open No. 2008-65200. In the configuration proposed in Japanese Patent Application Laid-Open No. 2009-154420, light emitting elements in multiple rows are provided to a single line head. When the light emitting elements of the line head are switched in row units, operation can be performed without using rows including defective elements. With this, a high yield can be achieved. Further, in the method proposed in Japanese Patent Application Laid-Open No. 2008-65200, a light emitting portion of a single light emitting element is split into multiple sub light emitting portions. Specifically, in the method proposed in Japanese Patent Application Laid-Open No. 2008-65200, when one of the multiple sub light emitting portions becomes defective, only the defective part is disconnected from a pixel drive circuit. With this, electric current from the pixel drive circuit can be applied only to normal sub light emitting portions. Thus, the light emitting elements each can emit light with desired light intensity.

However, in the light emitting elements in multiple rows of Japanese Patent Application Laid-Open No. 2009-154420, when even single one of the light emitting elements in one row becomes defective, the row including the defective light emitting element is treated as a defective part. This state has no difference from the case of the light emitting element array of Japanese Patent Application Laid-Open No. H10-55890. Thus, when even single one of the light emitting elements in each column becomes defective in all the rows of the light emitting elements of the line head, the rows including the defective light emitting elements are each treated as a defective part. As a result, the line head itself is treated as a defective product. In particular, when even some of the rows of the light emitting elements have a high defect rate, a yield of the line head itself may be insufficient.

Meanwhile, in the method proposed in Japanese Patent Application Laid-Open No. 2008-65200, print image quality may not be maintained as described below. For example, in a case where a single pixel is split into two sub light emitting portions (portion A and portion B) in the method proposed in Japanese Patent Application Laid-Open No. 2008-65200, when the pixel is normal, both the two sub light emitting portions (portion A and portion B) emit light. However, when any of the two sub light emitting portions becomes defective, only non-defective one emits light (only the portion B when the portion A is defective). In this case, in a pixel having such a defective sub light emitting portion, electric current from the pixel drive circuit is applied only to the non-defective sub light emitting portion, and the non-defective sub light emitting portion emits strong light. Also with this, required total light intensity may be cooperatively achieved by all the pixels. However, light emitting areas of the pixels vary from each other depending on whether or not a defect has occurred, and hence unexpected unevenness in color tone appears on a printed material. As a result, there arises a problem of difficulty in maintaining print image quality.

SUMMARY OF THE INVENTION

The present invention has been made to solve the above-mentioned problems, and it is an object of the present invention to provide a printing apparatus that maintains print image quality and has a high yield.

According to one embodiment of the present invention, there is provided a printing apparatus including: a photosensitive drum; a substrate including multiple formable regions in each of which corresponding one of multiple light emitting elements is formable, the multiple light emitting elements being formed in at least two of the multiple formable regions; and a lens array for imaging light beams from the multiple light emitting elements on the photosensitive drum, in which the substrate is arranged in a manner that a longitudinal direction of the substrate is parallel to a rotary shaft of the photosensitive drum, in which the substrate includes m formable region rows, where m is an integer number equal to or greater than 2, each of the m formable region rows including n formable regions, where n is an integer number equal to or greater than 1, arranged in a line along the longitudinal direction of the substrate, and in which one of the multiple light emitting elements formed in any one of m formable regions that are located in a predetermined column of the m formable region rows is turned on.

Further features of the present invention will become apparent from the following description of exemplary embodiments with reference to the attached drawings.

DESCRIPTION OF THE EMBODIMENTS

Figure 1:
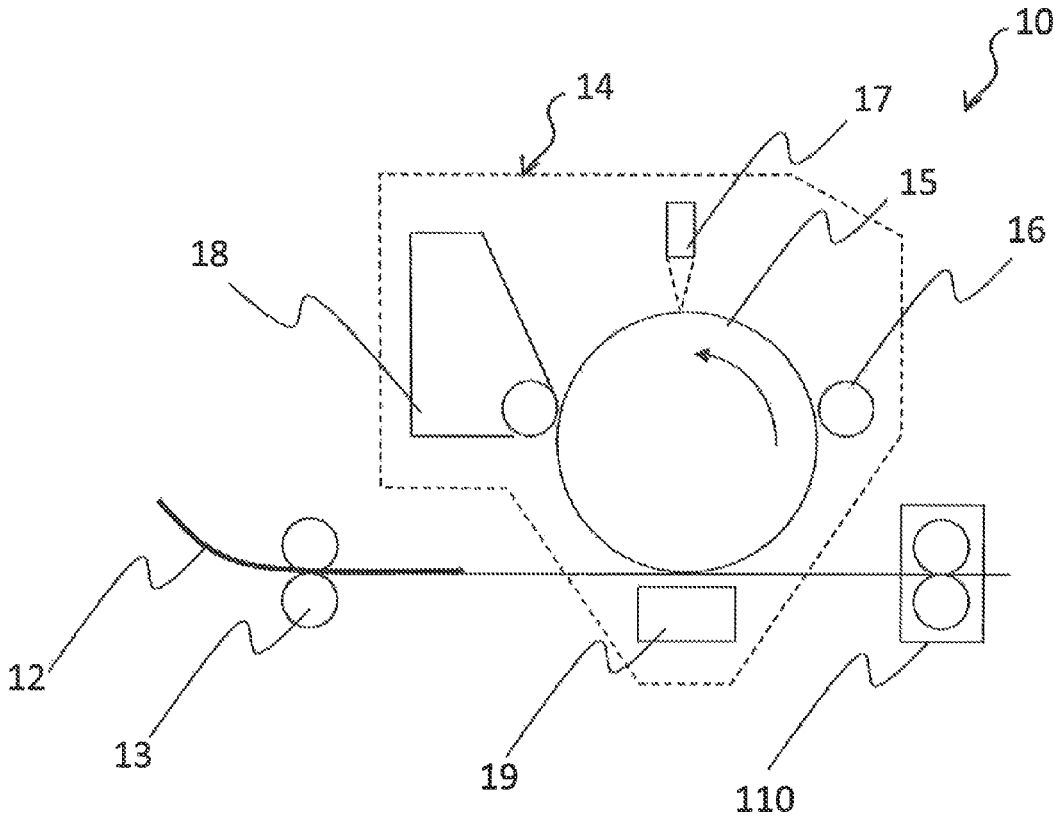
FIG. 1 is a schematic view of a printing apparatus according to Embodiment 1 of the present invention.

Preferred embodiments of the present invention will now be described in detail in accordance with the accompanying drawings.

A printing apparatus according to the present invention includes a photosensitive drum, a substrate having multiple formable regions in each of which corresponding one of multiple light emitting elements can be formed, and a lens array for imaging light beams from the multiple light emitting elements on the photosensitive drum. Note that, in the present invention, the multiple light emitting elements are formed in at least two of the multiple formable regions.

In the present invention, the substrate is arranged in a manner that a longitudinal direction thereof is parallel to a rotary shaft of the photosensitive drum. Further, this substrate includes m formable region rows (m is an integer number equal to or greater than 2). Each of the m formable region rows includes n formable regions (n is an integer number equal to or greater than 1) arranged in a line along the longitudinal direction of the substrate.

In the present invention, a light emitting element formed in any one of m formable regions that are located in a predetermined column of the m formable region rows.

In the following, printing apparatus according to Embodiments of the present invention are described with reference to the drawings. Note that, well-known or publicly known technologies in the field to which the present invention belongs are applicable to matters that are not particularly illustrated in the drawings and matters that are not particularly described in the following description. Further, Embodiments described below are merely exemplary ones of the present invention, and hence the present invention is not limited to those embodiments.

Embodiment 1

FIG. 1 is a schematic view of the printing apparatus according to this embodiment of the present invention. A printing apparatus 10 of FIG. 1 includes a recording unit 14 including a columnar photosensitive drum 15, and members provides around the photosensitive drum 15, specifically, a charging device 16, an exposure head 17, a developing device 18, and a transfer device 19. Note that, in the printing apparatus 10 of FIG. 1, among the components of the recording unit 14, members other than the photosensitive drum 15, specifically, the charging device 16, the exposure head 17, the developing device 18, and the transfer device 19 are arranged in this order along a rotation direction of the photosensitive drum 15.

When the printing apparatus 10 of FIG. 1 is driven to perform printing, the photosensitive drum 15 is rotated in a predetermined rotation direction, for example, in a counterclockwise direction as illustrated in FIG. 1. Note that, the predetermined rotation direction refers to a rotation direction in which the photosensitive drum 15 sequentially faces the charging device 16, the exposure head 17, the developing device 18, and the transfer device 19, and hence is not necessarily limited to the counterclockwise direction illustrated in FIG. 1. In this context, a surface condition of the photosensitive drum 15 at the time when the photosensitive drum 15 is rotated to face the other members of the recording unit 14 is described below.

When the rotated photosensitive drum 15 faces the charging device 16, the surface of the photosensitive drum 15 is uniformly charged by the charging device 16. Then, when the photosensitive drum 15 faces the exposure head 17, the exposure head 17 emits light in accordance with image data. In this way, an electrostatic latent image is formed on the photosensitive drum 15. Note that, the electrostatic latent image formed on (the surface of) the photosensitive drum 15 can be controlled with light intensity (illuminance and time) of the exposure head 17 to (the surface of) the photosensitive drum 15. Next, toner is caused to adhere to the surface of the photosensitive drum 15 along the electrostatic latent image by the developing device 18. Note that, the toner that is caused to adhere to the surface of the photosensitive drum 15 is transferred onto a sheet 12 by the transfer device 19. Note that, the sheet 12 onto which the toner is transferred is conveyed with a conveying roller pair 13 that is provided in a main body of the printing apparatus toward the transfer device 19 of the recording unit 14. By the processes described above, the image data is transferred as a toner image onto a front surface of the sheet 12 with the recording unit 14. After that, the toner adhering to the front surface of the sheet 12 is fixed with a fixing device 110, and then the sheet 12 is delivered to an outside of the apparatus. Note that, the printing apparatus in the example described in this embodiment includes the single recording unit 14, specifically, is a monochromatic printing apparatus, but the present invention is not limited to this specific example. As an example of the printing apparatus, there may be given a color printing apparatus including multiple recording units 14.

Figure 2:
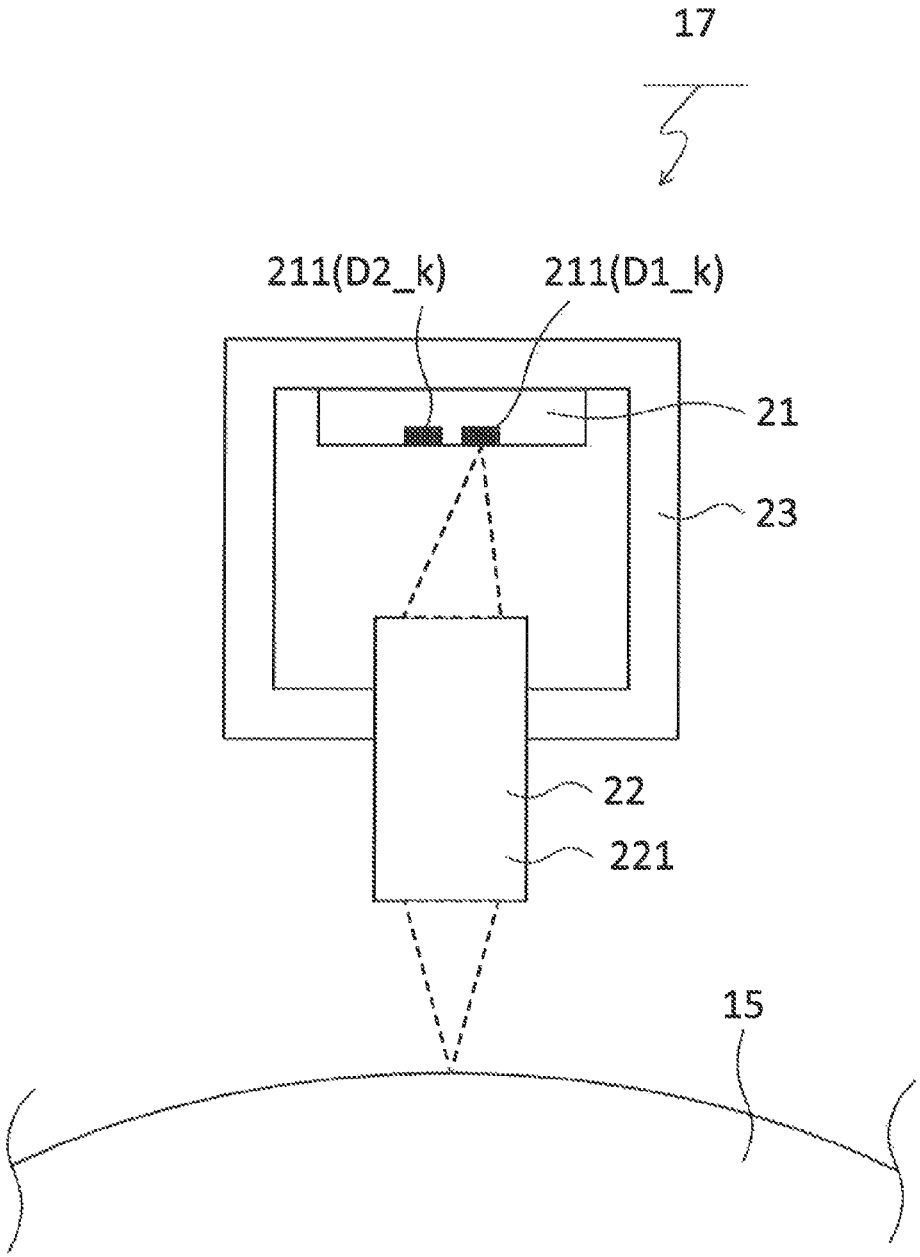
FIG. 2 is a schematic sectional view of an exposure head of the printing apparatus of FIG. 1.

FIG. 2 is a schematic sectional view of the exposure head of the printing apparatus of FIG. 1. The exposure head 17 of FIG. 2 includes a light emitting element array 21, a lens array 22, and a casing 23 for fixing the light emitting element array 21 and the lens array 22 to predetermined positions. In other words, the light emitting element array 21 and the lens array 22 of the exposure head 17 of FIG. 2 are fixed to the casing 23 at a fixed clearance secured therebetween by the casing 23. Note that, as an example of the light emitting element array 21 of the exposure head 17 of FIG. 2, there is given an OLED array including organic EL elements. Note that, light emitting element arrays that include light emitting elements other than the organic EL elements (such as inorganic EL elements and light emitting diodes) may be used.

In the exposure head 17 of FIG. 2, the light emitting element array 21 includes multiple light emitting elements 211 that are arranged according to a predetermined rule, which is described in detail below. Note that, as described below, the light emitting element array 21 is formed by arraying the light emitting elements 211 in multiple straight lines, and is arrayed parallel to the rotary shaft of the columnar photosensitive drum 15. In the exposure head 17 of FIG. 2, the lens array 22 is arranged between the light emitting elements 211 and the photosensitive drum 15. The lens array 22 is formed by arraying a large number of rod lenses 221. In the exposure head 17 of FIG. 2, light beams emitted from the light emitting elements 211 transmit through the rod lenses 221, and are imaged on the surface of the photosensitive drum 15.

As viewed in a direction of a lateral cross-section of the photosensitive drum 15, the exposure head 17 of FIG. 2 includes at least two light emitting elements (D2_k and D1_k). In the present invention, one of those two light emitting elements (D2_k and D1_k) selectively emits light. Note that, how light emission of those two light emitting elements (D2_k and D1_k) are controlled is described below.

Figure 3:
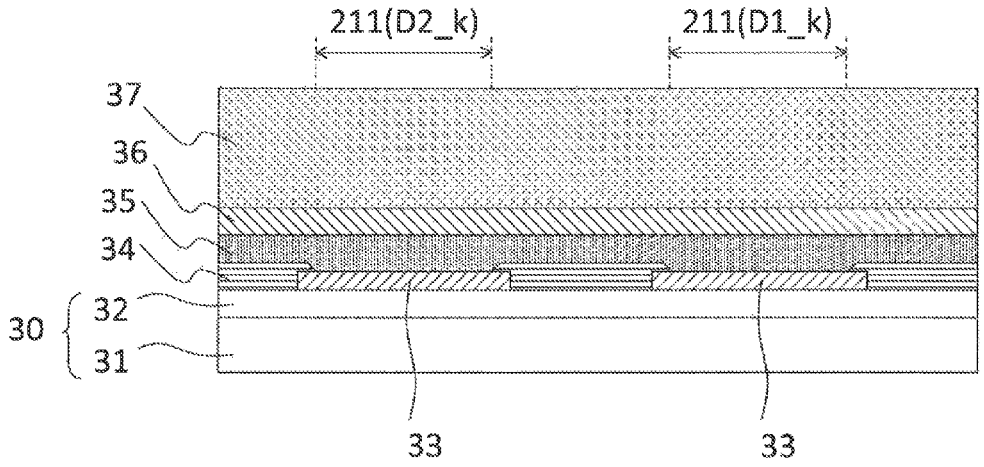
FIG. 3 is a schematic sectional view of a configuration example of light emitting elements of the exposure head of FIG. 2.

FIG. 3 is a schematic sectional view of a configuration example of the light emitting elements of the exposure head of FIG. 2. The light emitting elements 211 of the exposure head 17 of FIG. 2 mainly includes anodes (lower electrodes) 33 provided on a substrate 30, an organic EL layer 35, and a cathode (upper electrode) 36. The light emitting elements 211 illustrated in FIG. 3 are each a bottom emission type light emitting element for extracting light, which is output from (an emission layer of) the organic EL layer 35, to a lower side in FIG. 3 through a surface of the substrate 30. Note that, the present invention is not limited to the bottom emission type, and a top emission type light emitting element may be employed.

The substrate 30 for the light emitting elements 211 of FIG. 3 specifically includes a base 31 made of a light transmissive material such as glass, and an underlying layer 32 formed on the base 31. Note that, in FIG. 3, a drive circuit (not shown) for activating the light emitting elements 211, such as a thin film transistor, is provided on the base 31. The underlying layer 32 is provided as a layer for eliminating unevenness that is formed as a result of provision of the drive circuit.

As for the light emitting elements of the bottom emission type, the anode electrodes 33 formed on the underlying layer 32 are each a light transmissive electrode film. Specifically, the electrode film is made of a transparent conductive material such as an ITO, or is a metal electrode film obtained by forming a metal material such as Ag with a small thickness of approximately 10 nm.

The respective anode electrodes 33 of the two light emitting elements 211 illustrated in FIG. 3 are sectioned electrodes in element units. Further, the anode electrodes 33 are arrayed straight on the substrate 30, and end portions thereof are covered with an element isolation layer 34 for dividing the light emitting elements 211.

The organic EL layer 35 provided on the anode electrodes 33 and the element isolation layer 34 is formed of a single layer or a laminate of multiple layers including an emission layer. In a case where the organic EL layer 35 is a laminate formed of the multiple layers, as examples of layers other than the emission layer of the organic EL layer 35, there are given hole injection layers, hole transport layers, electron transport layers, and electron injection layers. Further, publicly known materials can be used as materials for the organic EL layer 35 (organic light emitting material, hole injection and transportation material, electron injection and transportation material, and the like).

The cathode electrode 36 provided on the organic EL layer 35 is a reflective electrode, and serves as a common electrode for the light emitting elements. As a specific example of the cathode electrode 36, there is given a metal electrode made of a metal material having a high reflectance, such as Al and Ag.

The light emitting elements 211 of FIG. 3, specifically, the organic EL layer 35 is protected from oxygen and moisture in the air by a protective layer 37 provided on the cathode electrode 36. The protective layer 37 is a film made of inorganic materials such as SiN and SiON. Further, it is preferred that the film to be formed into the protective layer 37 have a film thickness of from 0.1 μm or more to 10 μm or less. Still further, it is preferred that a CVD method be employed as a method of forming the protective layer 37. Yet further, when a surface of the protective layer 37 becomes uneven in conformity with the cathode electrode 36 and the like as an underlayer, the protective layer 37 may be formed by laminating a film made of an inorganic material and a film made of an organic material.

Note that, in the present invention, as a member for protecting the light emitting elements 211, there may be separately prepared a glass cover instead of the protective layer 37 so that a periphery of the light emitting element array 21 is sealed with this cover. In this way, the light emitting elements 211 may be protected from outside moisture, oxygen, and contaminants. Alternatively, the protective layer 37 may be made of a metal material. Still alternatively, a metal cover may be used instead of the glass cover so as to seal and protect the light emitting elements 211.

Figure 4A:
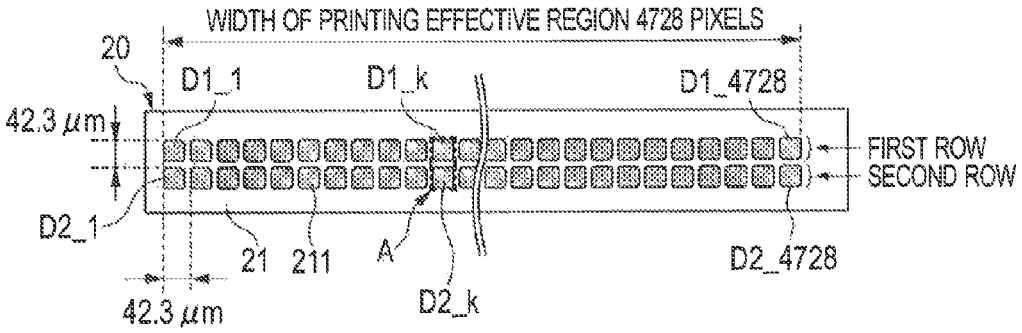
FIG. 4A is a schematic plan view of a first configuration example of a light emitting element array of the exposure head.
Figure 4B:
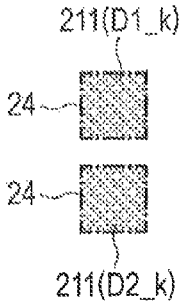
FIG. 4B is an enlarged view of a dotted-line surrounded area A in FIG. 4A.

Next, the light emitting element array of the exposure head 17 is described. FIG. 4A is a schematic plan view of a first configuration example of the light emitting element array of the exposure head 17, and FIG. 4B is an enlarged view of a dotted-line surrounded area A in FIG. 4A. Note that, the light emitting element array 21 of FIG. 4A is a light emitting element array of a printing apparatus that performs printing at a resolution of 600 dpi.

In the light emitting element array 21 of FIG. 4A, the light emitting elements 211 (for example, organic EL elements) are arrayed in 4,728 columns and 2 rows on a substrate 20, and an interval (pixel pitch) of 42.3 μm is secured between adjacent light emitting elements. Thus, printing is performed at a processing speed such that the pixels are arrayed at the pitch of 42.3 μm in the rotation direction of the photosensitive drum. Note that, image data corresponding to 6,785 rows in one page is input to the light emitting element array 21 of FIG. 4A. Further, in the light emitting element array 21 of FIG. 4A, a width of a printing effective region on a longitudinal side is 287 mm, and a width of a printing effective region on a short side is 200 mm. Thus, by using the light emitting element array 21 of FIG. 4A, printing can be performed on sheets of up to A4 size (210 mm×297 mm).

In this embodiment, in the light emitting element array 21 illustrated in FIG. 4A, light emitting elements provided in a first row are denoted by D1_1, D1_2, . . . D1_k, . . . D1_4728 from the left end. Further, light emitting elements provided in a second row are denoted by D2_1, D2_2, . . . D2_k, . . . D2_4728 from the left end. Note that, in the light emitting element array 21 illustrated in FIG. 4A, when the substrate 20 includes formable regions for light emitting elements in n columns and m rows, in formable regions in a k-th column, m light emitting elements, that is, the light emitting elements D1_k, D2_k, . . . Dj_k, . . . Dm_k are provided. Here, n, m, k, and j are each an integer number equal to or greater than 1, and satisfy the following conditions.

$$1 \leq n$$

$$2 \leq m$$

$$1 \leq k \leq n$$

$$2 \leq j \leq m$$

Note that, in this embodiment, the light emitting elements are provided in two rows, but the light emitting elements need not necessarily be provided in two rows, and may be provided in three or more rows.

Further, as illustrated in FIG. 4B, the light emitting elements (light emitting elements 211) of the light emitting element array 21 are respectively provided within formable regions 24 that are partial regions on the substrate 20. In other words, the light emitting element array 21 of FIG. 4A includes formable regions in 4,728 columns and 2 rows. Note that, in the light emitting element array 21 of FIG. 4A, the light emitting elements are each provided to occupy an entire of corresponding one of the formable regions (FIG. 4B). However, in the present invention, a configuration of forming the light emitting elements to the formable regions is not limited to the configuration of FIG. 4B.

Figure 5A:
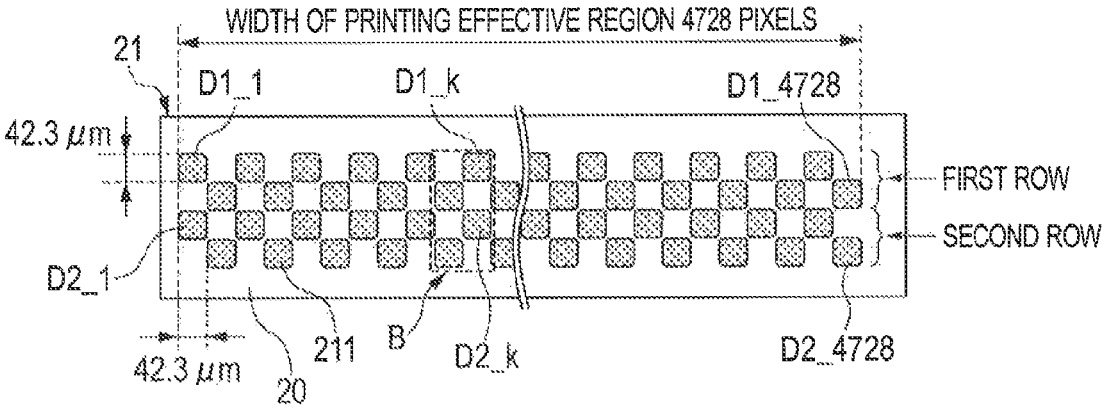
FIG. 5A is a schematic plan view of a second configuration example of the light emitting element array of the exposure head.
Figure 5B:
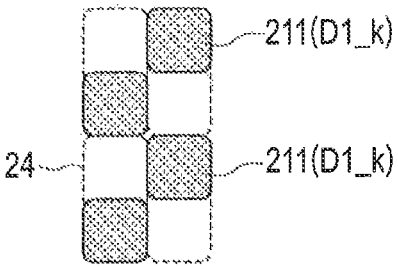
FIG. 5B is an enlarged view of a dotted-line surrounded area B in FIG. 5A.

FIG. 5A is a schematic plan view of a second configuration example of the light emitting element array of the exposure head 17, and FIG. 5B is an enlarged view of a dotted-line surrounded area B in FIG. 5A. In the present invention, as illustrated in FIG. 5B, the light emitting elements (light emitting elements 211) of the light emitting element array 21 may each be provided to occupy a part of corresponding one of the formable regions. Note that, when the light emitting elements are each provided to occupy a part of corresponding one of the formable regions, it is desired that the multiple light emitting elements be formed into the same shape, and multiple light emitting elements arranged in the same column have centers that are aligned with each other. It is preferred that each of the light emitting elements be provided in any one of regions that are obtained by bisecting the formable region in a short side direction of the substrate 20. For example, as illustrated in FIG. 5B, each of the light emitting elements is arranged in an upper side or a lower side of the regions that are obtained by bisecting the formable region in the short side direction of the substrate 20. When the light emitting elements are each provided to occupy a part of corresponding one of the formable regions, it is preferred that a staggered arrangement illustrated in FIG. 5A be employed as the pattern of forming the light emitting elements.

Figure 6:
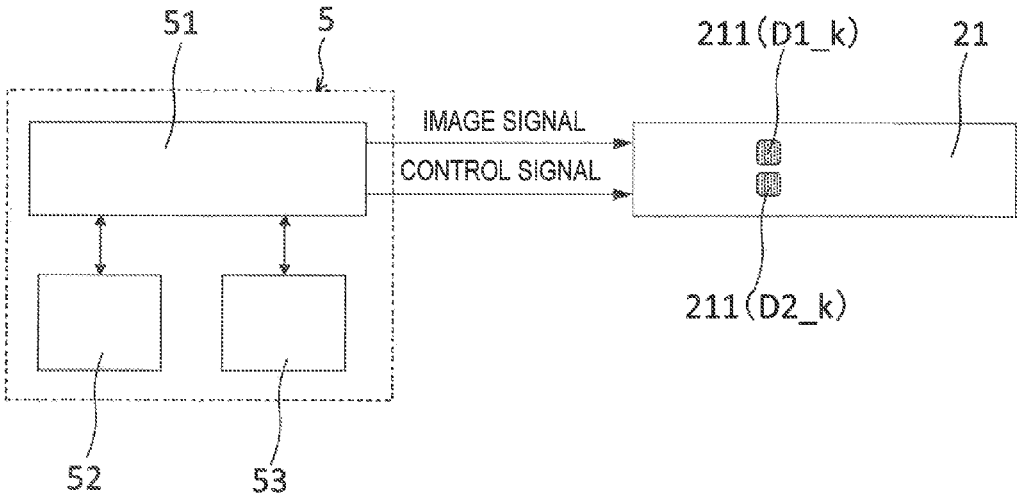
FIG. 6 is a schematic view of a first example of a control system for the light emitting elements of the light emitting element array of FIG. 4A or FIG. 5A.

FIG. 6 is a schematic view of a first example of a control system for the light emitting elements of the light emitting element array of FIG. 4A or FIG. 5A. A control system 5 illustrated in FIG. 6 includes a light emitting element array controller 51, a position information memory 52, and an image information memory 53. In the control system 5 of FIG. 6, an image signal and a control signal that are sent to the light emitting element array 21 are each input from the light emitting element array controller 51. Further, the position information memory 52 of the light emitting element array controller 51 stores which of the two light emitting elements (D1_k and D2_k) provided in a predetermined column k in the light emitting element array is selected. In addition, the image information memory 53 of the light emitting element array controller 51 corresponds at most to a single row.

Figure 7:
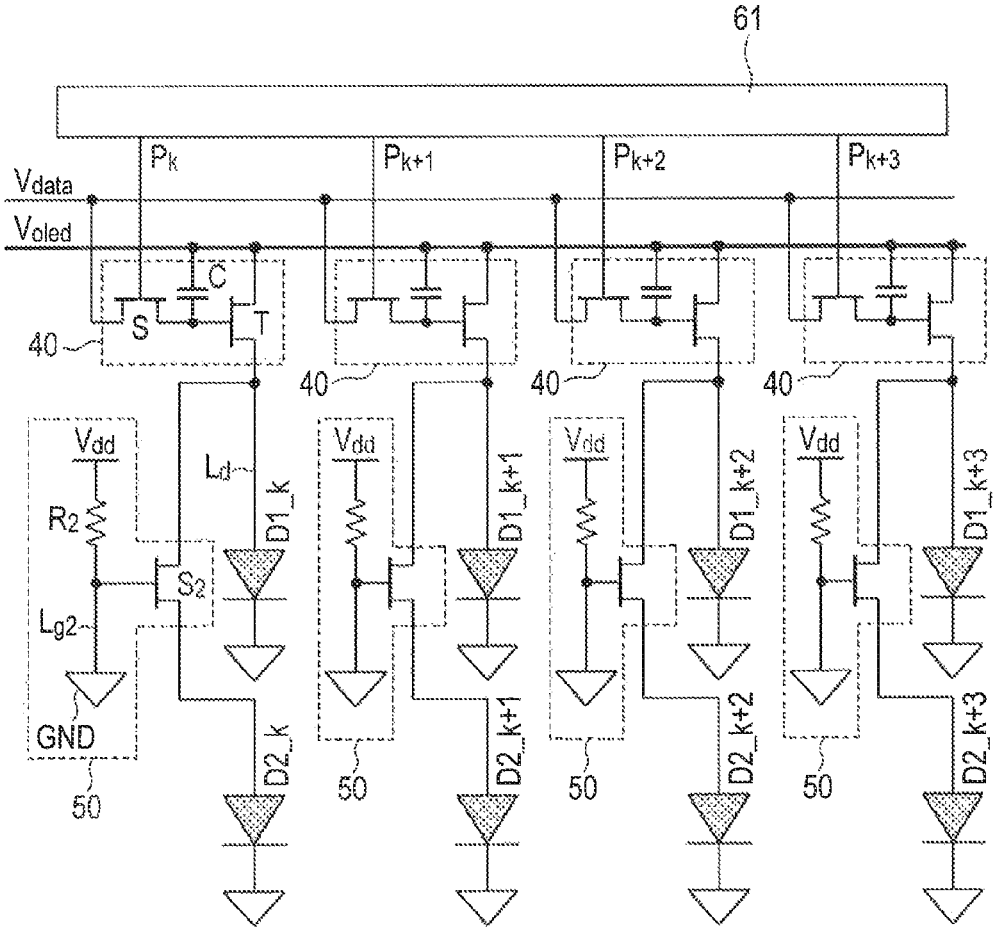
FIG. 7 is a circuit diagram of a first example of a drive circuit for the light emitting element array of FIG. 4A or FIG. 5A.

Next, pixel drive circuits for supplying electric current necessary for driving the light emitting elements of the light emitting element array 21, and selection circuits for selectively driving predetermined ones of the multiple light emitting elements (for example, D1_k and D2_k) are described. FIG. 7 is a circuit diagram of a first example of a drive circuit for the light emitting element array of FIG. 4A or FIG. 5A. Note that, in the following description, multiple light emitting positions may be referred to as pixels. Further, the pixels each include corresponding one of the light emitting elements.

The drive circuit of FIG. 7 includes a scanning circuit 61, pixel drive circuits 40, and selection circuits 50. In the drive circuit of FIG. 7, the scanning circuit 61 includes a single scanning circuit 61, and sends signals ($P_k$, $P_{k+1}$, $P_{k+2}$, $P_{k+3}$, . . . ) for driving the pixel drive circuits 40 respectively to pixel groups in respective columns. In the drive circuit of FIG. 7, the pixel drive circuits 40 are provided respectively to the pixel groups in the respective columns, and each include a switching transistor S, a storage capacitor C, and a current drive transistor T. In the drive circuit of FIG. 7, as well as the pixel drive circuits 40, the selection circuits 50 are provided respectively to the pixel groups in the respective columns, and each include a resistor $R_2$ and a switching transistor $S_2$. Note that, the pixel drive circuits 40 of the drive circuit of FIG. 7 are merely a specific example, and hence the present invention is not limited to the configuration illustrated in FIG. 7. Further, the number of the selection circuits that are provided respectively to the pixel groups in each one of the columns depends on the number of pixels in each of the pixel groups. Thus, the selection circuits are not necessarily provided respectively to the pixel groups in each one of the columns as illustrated in FIG. 7.

Next, a series of processes of driving a predetermined pixel, specifically, the light emitting element D1_k of a pixel in the k-th column and a first row is described with reference to the drive circuit of FIG. 7. Those processes include the following processes (i) and (ii).

(i) Process of driving a pixel drive circuit in the k-th column.

(ii) Process of driving a light emitting element D1_k.

First, the process of driving the pixel drive circuit 40 is described.

(ia) Data Writing

In order to drive the pixel drive circuit 40 in the k-th column, first, data writing is performed in the pixel drive circuit 40 provided in a pixel group in the k-th column. Specifically, in response to the scanning signal $P_k$ sent from the scanning circuit 61, the switching transistor S of the pixel drive circuit 40 is switched to an ON state. At this time, information voltage $V_{data}$ of the image data is stored in the storage capacitor C. With this, the data writing is completed.

(ib) Output of Drive Voltage ($V_{oled}$)

Next, in response to the scanning signal $P_k$ sent from the scanning circuit 61, the switching transistor S of the pixel drive circuit is switched to an off state. With this, the information voltage $V_{data}$ is maintained to be stored in the storage capacitor C until the switching transistor S is turned on next time. Further, while the switching transistor S is turned ON, the current drive transistor T is turned on by the information voltage $V_{data}$. The information voltage $V_{data}$ causes drive voltage ($V_{oled}$) and drive current for driving the light emitting element D1_k to be output.

When the pixel drive circuit in the k-th column is driven by the above-mentioned processes, the drive voltage ($V_{oled}$) and the drive current for driving the light emitting element D1_k of the multiple light emitting elements in the pixel group in the k-th column are output. The drive voltage ($V_{oled}$) and the drive current are input as output from the pixel drive circuit to the light emitting element D1_k that is connected to a wiring $L_d$. With this, the light emitting element D1_k emits light.

Next, functions of the selection circuit are described.

In the light emitting element array having the drive circuit of FIG. 7, when the light emitting element D1_k of the light emitting elements (D1_k and D2_k) in a pixel group in a predetermined column, for example, in the k-th column emits light, the selection circuit 50 is activated as follows. Specifically, a gate electrode of the switching transistor $S_2$ is connected to a GND potential, and hence the switching transistor $S_2$ is in an off state. With this, electric current from the current drive transistor T is selectively input to the light emitting element D1_k, and hence the light emitting element D1_k selectively emits light.

Note that, when the m light emitting elements are provided in the formable regions in the k-th column, as well as the light emitting element D1_k, the light emitting element Dj_k in a j-th row emits light with the drive voltage ($V_{oled}$) and the drive current output from the pixel drive circuit. At this time, an output of the pixel drive circuit is connected to a switching transistor $S_j$. Note that, as for the light emitting element Dj_k, a first voltage line (GND) for initially turning off the switching transistor $S_j$ and a gate electrode of the switching transistor $S_j$ are connected to each other with a wiring $L_{gj}$. Thus, in this phase, the light emitting element Dj_k does not emit light. Meanwhile, by taking a measure against a trouble of the light emitting element described below, a second voltage line ($V_{dd}$) for turning on the switching transistor $S_j$ and the gate electrode of the switching transistor $S_j$ are connected to each other via a resistor $R_j$, and thus the light emitting element Dj_k emits light.

Figure 8:
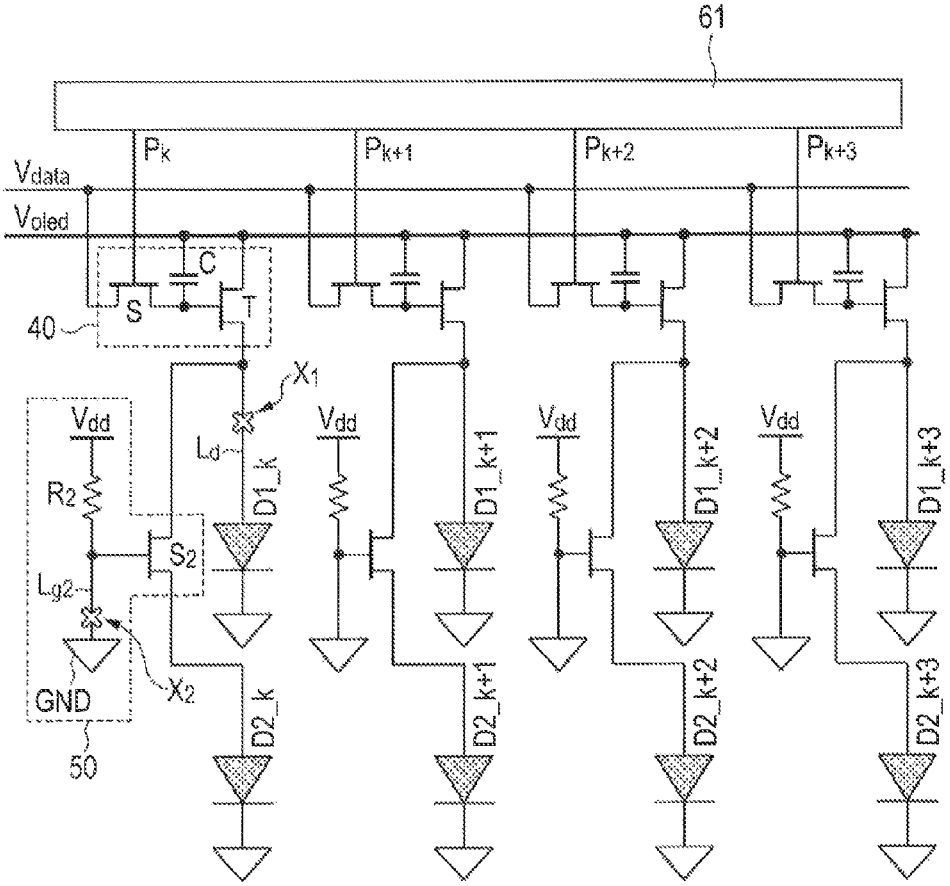
FIG. 8 is an explanatory diagram of a specific measure against a case where a trouble has occurred in particular one of the light emitting elements of the light emitting element array having the drive circuit of FIG. 7.

FIG. 8 is an explanatory diagram of the specific measure against a case where the trouble has occurred in particular one of the light emitting elements of the light emitting element array having the drive circuit of FIG. 7. Note that, the trouble in this case is generally a defect (light failure) of the light emitting element D1_k. However, even when the light emitting element D1_k can be turned on, the light emitting element D1_k may be regarded as a defective element depending on a degree of luminance deterioration of the light emitting element D1_k.

When the light emitting element D1_k of the light emitting element array having the drive circuit of FIG. 7 is free from the trouble, the output from the pixel drive circuit (drive voltage ($V_{oled}$) and drive current) is supplied to the light emitting element D1_k without disconnecting the two wiring lines illustrated in FIG. 7, that is, the lines $L_d$ and $L_{gj}$. Meanwhile, when the light emitting element D1_k in the pixel group in the k-th column becomes defective, any other light emitting elements in the pixel group in the k-th column need to be caused to emit light. In this case, the light emitting element D2_k needs to be caused to emit light. In order to cause the light emitting element D2_k to emit light, the switching transistor $S_2$ is switched to an on state, and a measure to selectively input the electric current from the current drive transistor T to the light emitting element D2_k is taken. Specifically, the wiring $L_d$ and a wiring $L_{g2}$ are disconnected respectively at a point $x_1$ and a point $x_2$ by laser beam radiation.

The wiring $L_d$ is disconnected at the point $x_1$, and hence a current path between the current drive transistor T and the light emitting element D1_k is interrupted. Thus, the drive voltage ($V_{oled}$) and the drive current that are output from the current drive transistor T flow toward the switching transistor $S_2$. Further, the wiring $L_{g2}$ is disconnected at the point $x_2$ by the laser beam radiation, and hence the gate electrode of the switching transistor $S_2$ is disconnected from the GND potential, and simultaneously is connected to the power supply potential ($V_{dd}$) via the resistor $R_2$. In this way, the switching transistor $S_2$ is switched to the on state.

By the operation (wiring disconnection operation) described above, the electric current from the current drive transistor T is input to the light emitting element D2_k. With this, the light emitting element D2_k emits light.

Note that, the above-mentioned selective light emission of predetermined light emitting elements and the above-mentioned measure against a case where the predetermined light emitting elements become defective (wiring disconnection for switching light emitting elements to be caused to emit light) are applicable also to light emitting elements in the pixel groups in columns other than the k-th column. Further, the method of disconnecting the circuit at the point $x_1$ and the point $x_2$ illustrated in FIG. 8 for switching light emitting elements to be caused to emit light in a predetermined column is not limited to the laser beam radiation.

By the way, the wiring disconnection operation illustrated in FIG. 8 is performed at the time of using the printing apparatus including the light emitting element array 21. For example, in an inspection step after manufacture of the light emitting element array 21, lighting tests of light emitting elements of pixels in a predetermined row of the light emitting element array 21 (for example, first row) are conducted. In a case where results of the tests have proved that none of the light emitting elements of the pixels in the predetermined row (first row) is defective, the light emitting element array 21 is shipped as it is as a part of a product together with other members. Meanwhile, when there is any defective element in the predetermined row (first row), position information of a pixel having the defective element is stored in the position information memory 52. Then, based on the position information, a part of the wiring $L_d$ and a part of the wiring $L_{g2}$ are disconnected by the laser beam radiation. When the light emitting element D1_k is defective, other light emitting elements in the same column, for example, the light emitting element D2_k is caused to emit light.

In this context, processes on printing image information to be input to the light emitting element array 21 of the printing apparatus according to this embodiment are described. Note that, also in other embodiments, the printing apparatus of the present invention includes the following units (1-1) to (1-3) for the processes on the printing image information.

(1-1) Unit configured to sequentially send printing image information items of a first row to a βth row (β is an integer number equal to or greater than 1) to the substrate in synchronization with rotation of the photosensitive drum.

(1-2) Unit configured to selectively turn on only the light emitting element Dj_k of multiple formable regions in the short side direction in a k-th column of the n formable regions arranged in the longitudinal direction of the substrate based on the sent printing image information items.

(1-3) Unit configured to send a printing image information item of an (α−j+1)th row to the light emitting element Dj_k at the time of sending a printing image information item of an αth row (α is an integer number equal to or greater than 1, $1 \leq \alpha \leq \beta$) to the light emitting elements D1__1 to D1_n.

Figure 9:
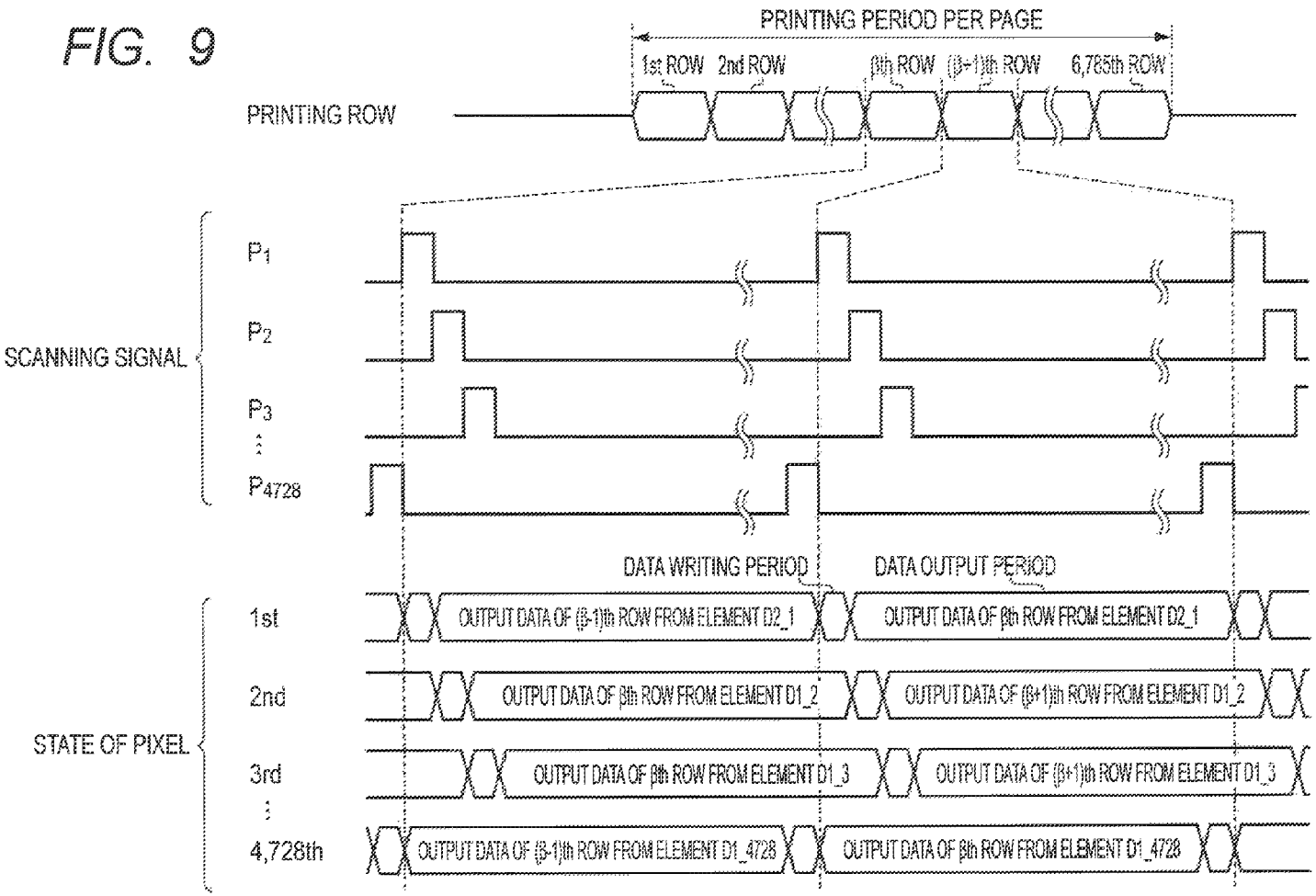
FIG. 9 is a drive timing chart of the light emitting element array of the printing apparatus according to Embodiment 1.
Figure 10:
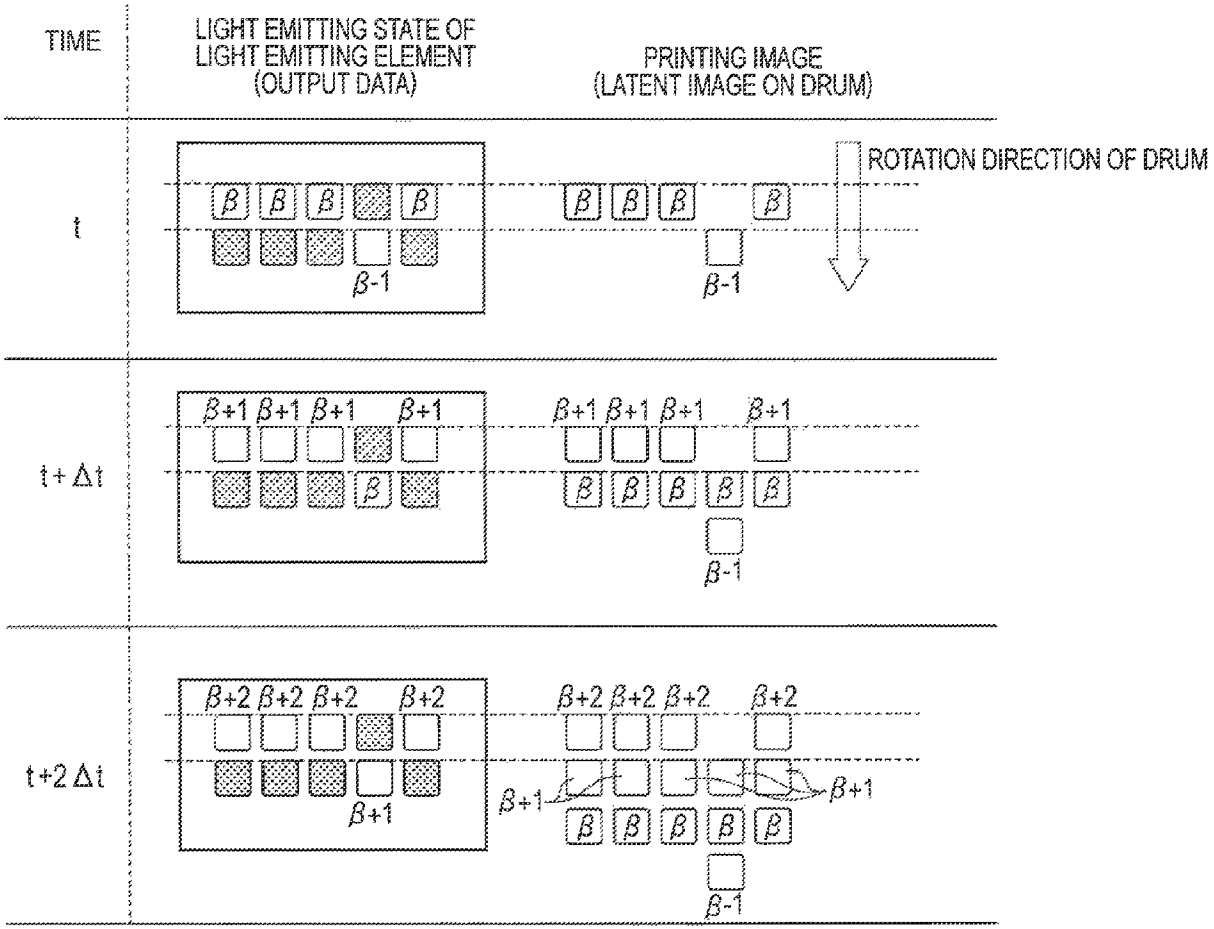
FIG. 10 is a chart showing relationships between light emitting states of the light emitting elements (organic EL (electroluminescence) elements) and printing images at predetermined timings.

FIG. 9 is a drive timing chart of the light emitting element array of the printing apparatus according to this embodiment. Further, FIG. 10 is a chart showing relationships between light emitting states of the light emitting elements (organic EL elements) and printing images at predetermined timings. Note that, as shown in FIG. 10, the light emitting states of the light emitting elements reflect output data of predetermined light emitting elements, and printing images reflect latent images to be formed on the photosensitive drum.

The printing apparatus according to this embodiment performs printing while rotating the photosensitive drum at a processing speed such that the pixels are arranged at the pitch of 42.3 μm in the rotation direction of the photosensitive drum. Further, at this time, of the light emitting elements arranged in the two rows in the light emitting element array 21, the light emitting element D2_k in the second row emits light in the k-th column, and light emitting elements in the first row emit light in other columns.

In this case, in pixels in the k-th column, a latent image is formed at a position shifted by an amount of a single row (42.3 μm) relative to pixels in other columns (FIG. 10). In this embodiment, image information that was supposed to be output from the light emitting element D1_k of a pixel in the k-th column and the first row is temporarily stored in the image information memory 53. Then, in accordance with the position information in the position information memory 52 and image information in the image information memory 53, image information items only of positions in the k-th column of the light emitting element array 21 are output while being sequentially shifted. Specifically, at a time point of outputting an image of a βth row in the first row (time point t), the light emitting element D2_k outputs an image of a (β−1)th row with reference to an image information item of the (β−1)th row (FIG. 9). In this context, when the printing is performed at a speed of approximately 25 sheets per minute, a printing time per page (printing period) is approximately 2.4 seconds. Further, image data to be input to the light emitting element array used in this embodiment corresponds to 6,785 rows in one page, and hence an input period for image data of a single pixel row ((Δt in FIG. 10)=data writing period+data output period) is approximately 350 μsec. In this context, although depending on the configuration of the pixel drive circuit, the data writing period per pixel ranges from approximately 5 μsec to 10 μsec. Note that, it is preferred that the data writing period be sufficiently smaller than the data output period. Further, rotation of the photosensitive drum is synchronized with the above-mentioned light emission timing, and hence it takes a time period of 350 μsec for the photosensitive drum to be rotated to move by 42.3 μm.

In the printing apparatus using the light emitting element array as an exposure head, by controlling the circuits and output as described above, print image quality can be maintained even when the light emitting elements of the light emitting element array become defective. Note that, an applicable range of this embodiment is not limited to the above-mentioned number or pitch of the pixels (light emitting elements in the pixels) of the light emitting element array 21, and can be appropriately changed in accordance with specifications of the printing apparatus.

Embodiment 2

Figure 11:
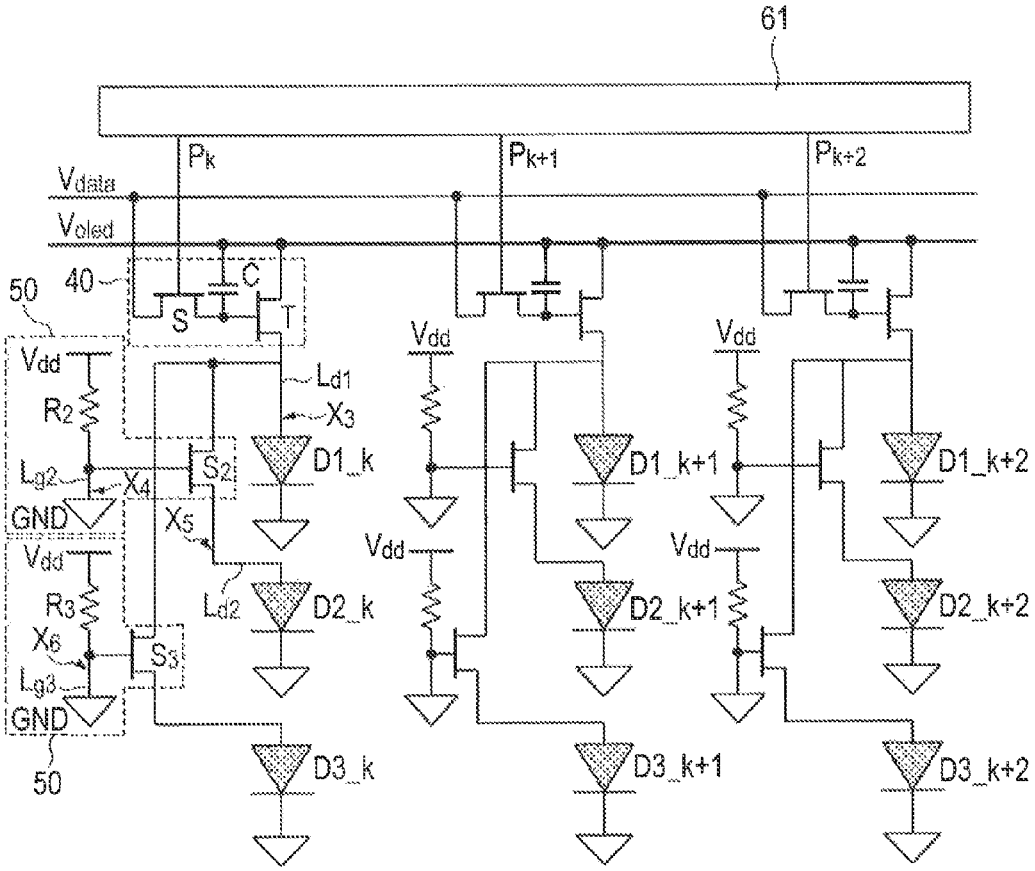
FIG. 11 is a circuit diagram of a printing apparatus according to Embodiment 2 of the present invention.

FIG. 11 is a circuit diagram of a printing apparatus according to this embodiment (Embodiment 2) of the present invention. In this embodiment, the drive circuit for the light emitting element array is partially different from that in Embodiment 1. In the following, this embodiment is described with a focus on the difference between this embodiment and Embodiment 1.

In the drive circuit illustrated in FIG. 11, the light emitting elements of the light emitting element array are arrayed in three rows. In other words, the pixels of the light emitting element array are arrayed in three rows. As illustrated in FIG. 11, in the present invention, the number of the rows of the light emitting elements of the light emitting element array of the printing apparatus is not particularly limited.

Further, in the light emitting element array having the drive circuit illustrated in FIG. 11, a circuit configuration for light emitting elements in a first row and a second row is the same as the circuit configuration illustrated in FIG. 7. In this context, in the light emitting element array having the drive circuit illustrated in FIG. 11, a circuit configuration of light emitting elements in a third row is obtained, for example, by adding the following wiring lines and electronic components to the circuit configuration illustrated in FIG. 7.

(2-1) Light emitting element D3_k (2-2) (Additional) selection circuit 50 including a switching transistor $S_3$ and a resistor $R_3$ (2-3) Wiring $L_3$ for connecting the current drive transistor T and the switching transistor $S_3$ to each other (2-4) Wiring $L_{d3}$ for connecting the switching transistor $S_3$ and the light emitting element D3_k to each other In the light emitting element array having the drive circuit illustrated in FIG. 11, in principle, light emitting elements in the first row (for example, D1_k) are caused to emit light. When the light emitting element D1_k becomes defective, wiring disconnection is performed in the same way as that illustrated in FIG. 8 (disconnection at a point $x_3$ in a wiring $L_{d1}$ and a point $x_4$ in the wiring $L_{g2}$) so as to cause the light emitting element in the second row (for example, D2_k) to emit light. Further, when the light emitting elements D1_k and D2_k become defective, predetermined wiring lines are disconnected, specifically, a wiring $L_{d2}$ is disconnected at a point $x_5$ and a wiring $L_{g3}$ is disconnected at a point $x_6$ so as to cause the light emitting elements in the third row (for example, D3_k) to emit light. In other words, in order to cause the light emitting element Dj_k to emit light in a case where the light emitting element D1_k is defective, the wiring $L_{d1}$ and the wiring $L_{gj}$ are disconnected.

Embodiment 3

Figure 12:
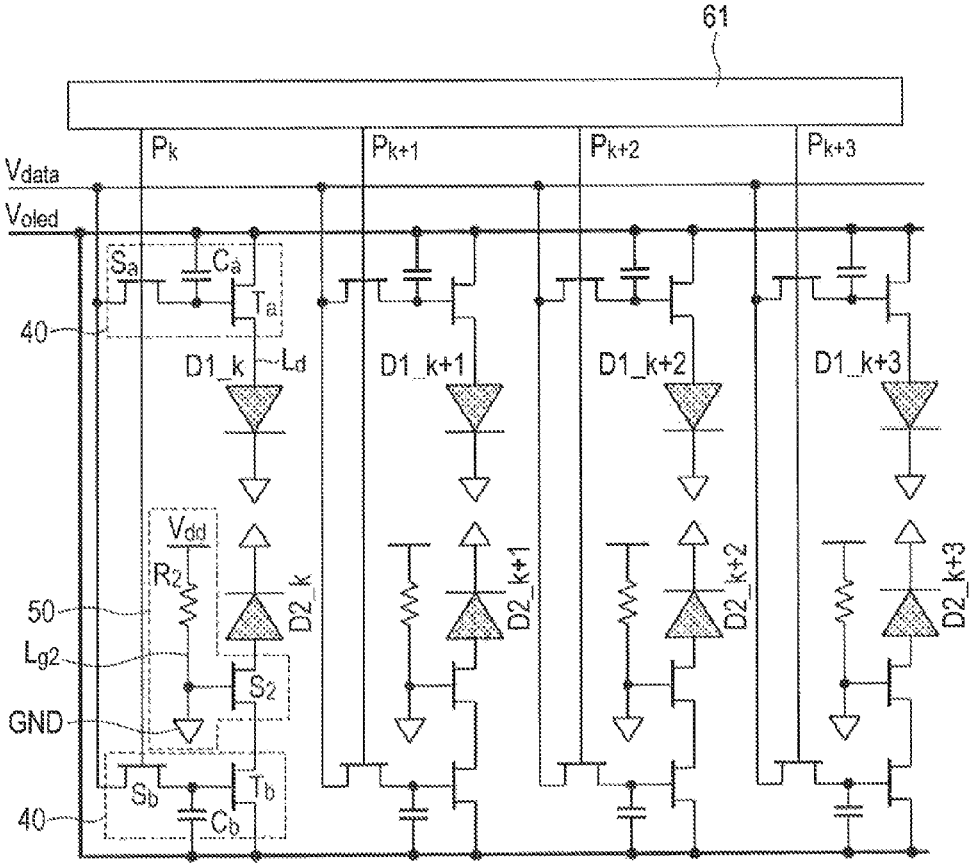
FIG. 12 is a circuit diagram of a printing apparatus according to Embodiment 3 of the present invention.

FIG. 12 is a circuit diagram of a printing apparatus according to this embodiment (Embodiment 3) of the present invention. In this embodiment, the drive circuit for the light emitting element array is partially different from that in Embodiment 1. In the following, this embodiment is described with a focus on the difference between this embodiment and Embodiment 1.

The light emitting element array of the printing apparatus according to this embodiment has the same circuit configuration as that of the light emitting element array of the printing apparatus according to Embodiment 1 except that the pixel drive circuits 40 are provided respectively to light emitting elements. Note that, in this embodiment, the pixel drive circuits 40 and the selection circuits 50 have the same basic configurations as those in Embodiment 1. Further, the configuration of the pixel drive circuits in this embodiment is not limited to the configuration illustrated in FIG. 12.

By the way, when the substrate 20 in this embodiment includes formable regions for pixels in n columns and m rows, the following members (3-1) (3-2) are provided to the substrate 20.

(3-1) "m" drive transistors T1_k, T2_k, . . . Tj_k ($2 \leq j \leq m$, j is an integer number), . . . Tm_k for controlling outputs of drive current in response to scanning signals (3-2) "m" light emitting elements D1_k, D2_k, . . . Dj_k, . . . Dm_k.

Next, a series of processes of driving a predetermined pixel, specifically, the light emitting element D1_k of a pixel in the k-th column and the first row is described with reference to the drive circuit of FIG. 12. Similarly to Embodiment 1, those processes include the following processes (i) and (ii).

(i) Process of driving a pixel drive circuit in the k-th column.

(ii) Process of driving a light emitting element D1_k.

First, the process of driving the pixel drive circuit 40 is described.

(ia) Data Writing

In order to drive the pixel drive circuit 40 in the k-th column, first, data writing is performed in the pixel drive circuits 40 provided in a pixel group in the k-th column. Specifically, in response to the scanning signal $P_k$ sent from the scanning circuit 61, both of the switching transistors ($S_a$ and $S_b$) of the respective pixel drive circuits 40 are switched to an on state. At this time, information voltage $V_{data}$ of the image data is stored in the storage capacitors ($C_a$ and $C_b$) of the respective pixel drive circuits 40. With this, the data writing is completed.

(ib) Output of Drive Voltage ($V_{oled}$)

Next, in response to the scanning signal $P_k$ sent from the scanning circuit 61, both of the switching transistors ($S_a$ and $S_b$) of the respective pixel drive circuits 40 are switched to an off state. With this, the information voltages $V_{data}$ are maintained to be stored in the storage capacitors ($C_a$ and $C_b$) until the switching transistors ($S_a$ and $S_b$) are turned on next time. Further, while the switching transistors S are turned ON, the current drive transistors ($T_a$ and $T_b$) of the respective pixel drive circuits 40 are turned on by the information voltages $V_{data}$. The information voltages $V_{data}$ cause drive voltages ($V_{oled}$) and drive currents for driving the light emitting elements (D1_k and D2_k) to be output. Note that, in the drive circuit of FIG. 12, when the selection circuit described below is driven, the drive voltage ($V_{oled}$) and the drive current for driving the light emitting element D2_k of the multiple light emitting elements in the pixel group in the k-th column are interrupted. Thus, the drive voltage ($V_{oled}$) and the drive current are input only to the light emitting element D1_k. In this way, the light emitting element D1_k is selectively caused to emit light.

Note that, in a case where m light emitting elements are provided in a pixel group in the k-th column, the light emitting element D1_k is connected to an output of the transistor T1_k with the wiring $L_d$. Thus, the light emitting element D1_k emits light at the time of output of the drive voltage ($V_{oled}$).

Meanwhile, the other elements, for example, the light emitting element Dj_k is connected to an output of the transistor Tj_k via the switching transistor $S_j$. Further, as for the light emitting elements other than the light emitting element D1_k, the first voltage line for initially turning off the switching transistor $S_j$ and the gate electrode of the switching transistor $S_j$ are connected to each other with the wiring $L_{gj}$. Thus, in a phase in which the light emitting element D1_k emits light, the light emitting element Dj_k does not emit light.

Figure 13:
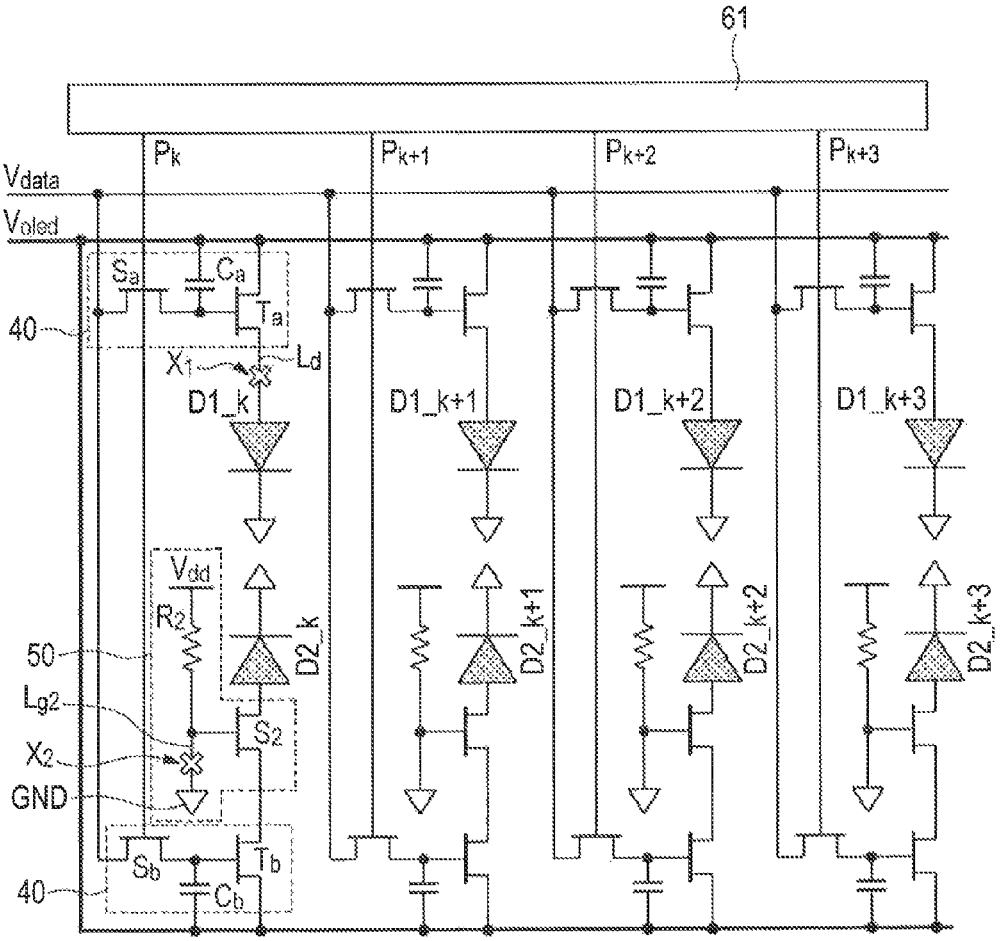
FIG. 13 is an explanatory diagram of a specific measure against a case where a trouble has occurred in particular one of the light emitting elements of a light emitting element array having the drive circuit of FIG. 12.

In this context, functions of the selection circuit in this embodiment are described. Note that, the following description of functions of the organic light emitting elements (D1_k and D2_k) in the pixel group in the k-th column is applicable also to pixel groups in the other columns. Further, FIG. 13 is an explanatory diagram of a specific measure against a case where a trouble has occurred in particular one of the light emitting elements of the light emitting element array having the drive circuit of FIG. 12.

First, in an initial state, electric current that has flown through the current drive transistor $T_a$ is input to the light emitting element D1_k. With this, the light emitting element D1_k emits light. Further, in the initial state, the gate electrode of the switching transistor $S_2$ is connected to the GND potential, and hence the switching transistor $S_2$ is in an off state. Thus, in the initial state, electric current that has flown through a current drive transistor $T_b$ is not input to the light emitting element D2_k, and hence the light emitting element D2_k does not emit light.

When the light emitting element D1_k becomes defective, the light emitting element D2_k is caused to emit light by the operation described below. First, the wiring $L_d$ is disconnected at the point $x_1$ by the laser beam radiation so that an electrical system connecting the current drive transistor $T_a$ and the light emitting element D1_k to each other is disconnected at the point $x_1$. Further, the wiring $L_{g2}$ is also disconnected by the laser beam radiation so that the gate electrode of the switching transistor $S_2$ and the GND potential are disconnected from each other at the point $x_2$. As a result of the disconnection of the wiring $L_{g2}$ at the point $x_2$, the gate electrode of the switching transistor $S_2$ is connected to the power supply potential ($V_{dd}$) via the resistor $R_2$. Thus, the switching transistor $S_2$ is switched to an on state. With this, the electric current that has flown through the current drive transistor $T_b$ is input to the light emitting element D2_k. Thus, the light emitting element D2_k emits light. Note that, the method of disconnecting the wiring $L_d$ and the wiring $L_{g2}$ is not limited to the method of using the laser beam radiation.

In general, when the light emitting element Dj_k is caused to emit light, it is only required to connect the second voltage line for turning on the switching transistor $S_j$ and the gate electrode of the switching transistor $S_j$ to each other via the resistor $R_j$.

As described above, in the printing apparatus according to this embodiment, the drive circuit is switched between the following states (3-1) and (3-2).

(3-1) State in which none of the wiring $L_d$ and the wiring $L_{gj}$ is disconnected so that output electric current from the transistor T1_k is supplied to the light emitting element D1_k, and that output electric current from the transistor Tj_k is not supplied to the light emitting element Dj_k.

(3-2) State in which the wiring $L_d$ and the wiring $L_{gj}$ are disconnected so that output electric current from the transistor T1_k is not supplied to the light emitting element D1_k, and that output electric current from the transistor Tj_k is supplied to the light emitting element Dj_k.

The light emitting element array of the printing apparatus according to this embodiment can be used by the same procedure as that in the case of Embodiment 1.

By controlling the circuits and output as described above, print image quality can be maintained as in Embodiment 1 even when the light emitting elements of the light emitting element array become defective.

Embodiment 4

In the method employed in Embodiments described above (Embodiments 1 to 3), in order to selectively cause one of the multiple light emitting elements in a pixel group in a predetermined column to emit light, some of the wiring lines in the drive circuit for the light emitting elements are disconnected. Note that, in the present invention, as the method of selectively causing one of the multiple light emitting elements to emit light, a method of using a control signal may be used instead of the disconnection of some of the wiring lines. In the following, a specific example of the method is described.

Figure 14:
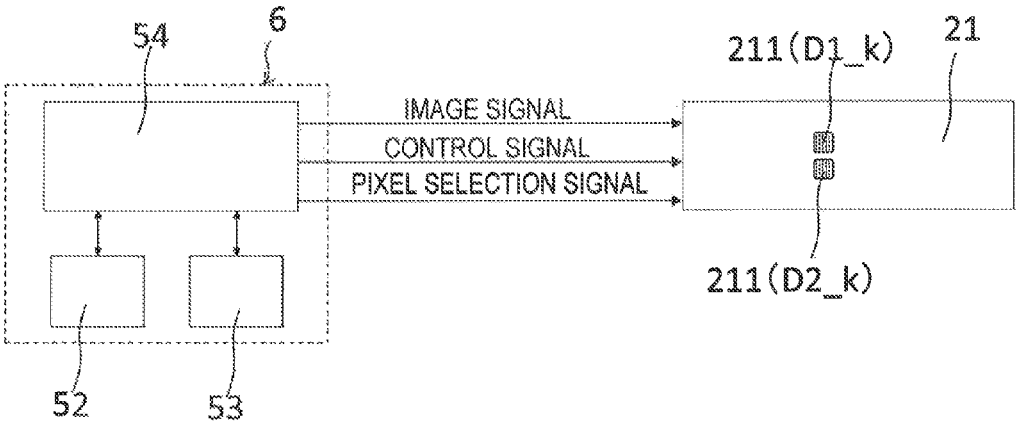
FIG. 14 is a schematic view of a second example of the control system for the light emitting elements of the light emitting element array of FIG. 4A or FIG. 5A.

FIG. 14 is a schematic view of a second example of the control system for the light emitting elements of the light emitting element array of FIG. 4A or FIG. 5A. A control system 6 illustrated in FIG. 14 has the same configuration as that of the control system 5 of FIG. 6 except that a light emitting element array controller 54 is capable of inputting not only the image signal and the control signal but also a pixel selection signal to the light emitting element array 21.

Figure 15:
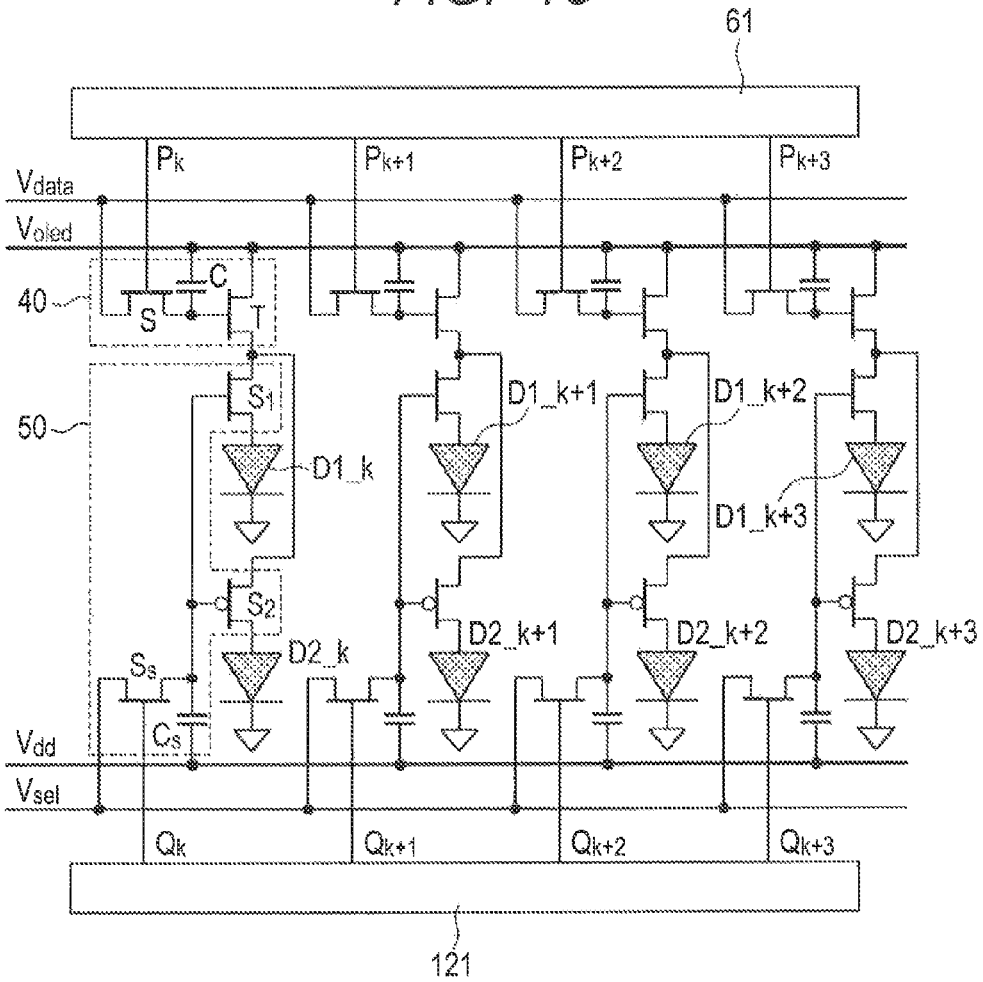
FIG. 15 is a circuit diagram of a printing apparatus according to Embodiment 4 of the present invention.

FIG. 15 is a circuit diagram of a printing apparatus according to this embodiment (Embodiment 4) of the present invention. In this embodiment, the drive circuit for the light emitting element array is partially different from that in Embodiment 1. In the following, this embodiment is described with a focus on the difference between this embodiment and Embodiment 1.

As well as the drive circuit of FIG. 7, the drive circuit of FIG. 15 includes the scanning circuit 61, the pixel drive circuits 40, the selection circuits 50, and the light emitting elements (D1_k and D2_k) of two types. The drive circuit of FIG. 15 further includes a second scanning circuit 121 in addition to the scanning circuit 61.

In the drive circuit of FIG. 15, the scanning circuit 61 includes a single scanning circuit 61, and sends signals ($P_k$, $P_{k+1}$, $P_{k+2}$, $P_{k+3}$, . . . ) for driving the pixel drive circuits 40 respectively to pixel groups in respective columns. In the drive circuit of FIG. 15, the pixel drive circuits 40 are provided respectively to the pixel groups in the respective columns, and each include the switching transistor S, the storage capacitor C, and the current drive transistor T. Note that, the pixel drive circuits 40 in FIG. 15 each output drive current in response to the scanning signal output from the scanning circuit 61. In this context, the scanning circuit 61 includes scanning lines (first scanning lines) for outputting the signals to the pixel drive circuits 40, which are provided as many as pixels in the row direction. The scanning lines are connected to the switching transistors S provided respectively to the pixel drive circuits 40, and the scanning signals are sent via the scanning lines.

In the drive circuit of FIG. 15, as well as the pixel drive circuits 40, the selection circuits 50 are provided respectively to the pixel groups in the respective columns. Specifically, the selection circuits 50 each include a storage capacitor $C_s$, a switching transistor $S_1$ (NMOS), the switching transistor $S_2$ (PMOS), and a switching transistor $S_s$. Further, the selection circuit 50 causes the light emitting element D1_k or the light emitting element D2_k to emit light.

In the drive circuit of FIG. 15, the storage capacitor $C_s$ of the selection circuit 50 stores selection information items of the light emitting element D1_k and the light emitting element D2_k. In the drive circuit of FIG. 15, the light emitting element D1_k is connected to an output of the pixel drive circuit 40 via the switching transistor $S_1$. In the drive circuit of FIG. 15, the light emitting element D2_k is connected to the output of the pixel drive circuit 40 via the switching transistor $S_2$. In the drive circuit of FIG. 15, both a gate electrode of the switching transistor $S_1$ and the gate electrode of the switching transistor $S_2$ are connected to the storage capacitor $C_s$ of the selection circuit 50.

In the drive circuit of FIG. 15, the scanning circuit 121 sends signals ($Q_k$, $Q_{k+1}$, $Q_{k+2}$, $Q_{k+3}$, . . . ) for controlling and driving the switching transistors $S_s$ provided in column units respectively to pixel groups in respective columns. Note that, the selection circuits 50 in FIG. 15 each output drive current in response to the scanning signal output from the scanning circuit 121. In this context, the scanning circuit 121 includes scanning lines (second scanning lines) for outputting the signals to the selection circuits 50, which are provided as many as pixels in the row direction. The scanning lines are connected to the switching transistors $S_s$ provided respectively to the selection circuits, and the scanning signals are sent via the scanning lines.

Note that, the pixel drive circuits 40 of the drive circuit of FIG. 15 are merely a specific example, and hence are not limited to the configuration illustrated in FIG. 15 in the present invention.

Next, with reference to the drive circuit of FIG. 15, a process of driving a pixel provided in a k-th column (k is an integer number equal to or greater than 1, $1 \leq k \leq n$) as a predetermined column of the n formable regions arranged in each of the rows, specifically, the light emitting element D1_k of a pixel in the k-th column and the first row is described. Those drive processes include the following processes (i) and (ii).

(i) Process of driving a pixel drive circuit in the k-th column.

(ii) Process of driving a light emitting element D1_k.

First, the process of driving the pixel drive circuit 40 is described.

(ia) Data Writing

In order to drive the pixel drive circuit 40 in the k-th column, first, data writing is performed in the pixel drive circuit 40 provided in a pixel group in the k-th column. Specifically, in response to the scanning signal $P_k$ sent from the scanning circuit 61, the switching transistor S of the pixel drive circuit 40 is switched to an on state. At this time, information voltage $V_{data}$ of the image data is stored in the storage capacitor C. With this, the data writing is completed.

(ib) Output of Drive Voltage ($V_{oled}$)

Next, in response to the scanning signal $P_k$ sent from the scanning circuit 61, the switching transistor S of the pixel drive circuit is switched to an off state. With this, the information voltage $V_{data}$ is maintained to be stored in the storage capacitor C until the switching transistor S is turned on next time. Further, while the switching transistor S is turned ON, the current drive transistor T is turned on by the information voltage $V_{data}$. The information voltage $V_{data}$ causes drive voltage ($V_{oled}$) and drive current for driving the light emitting element D1_k to be output. Note that, in this embodiment, the light emitting element D1_k is driven (emits light) at a time point when not only the output of the drive voltage ($V_{oled}$) and the drive current but also the process of driving the light emitting element D1_k, which is described below, is completed.

Next, the process of driving the light emitting element D1_k is described.

(iia) Selection Signal Writing

In this embodiment, as the process of driving the light emitting element D1_k, first, a selection signal is written. Specifically, the scanning signal $Q_k$ is sent from the scanning circuit 121 to the switching transistor $S_s$ in the k-th column. In response to the scanning signal $Q_k$, the switching transistor $S_s$ of the selection circuit 50 is switched to an on state. At this time, an information voltage based on a selection voltage $V_{sel}$ that controls the selection signal is stored in the storage capacitor $C_s$. Then, writing of the selection signal is completed.

(iib) Output of Drive Voltage ($V_{oled}$)

Next, in response to the scanning signal $Q_k$ sent from the scanning circuit 121, the switching transistor $S_s$ of the selection circuit is switched to an off state. With this, the selection signal is maintained to be stored in the storage capacitor $C_s$ until the switching transistor $S_s$ is turned on next time.

In this case, in order to cause the light emitting element D1_k of the light emitting elements in the k-th column to emit light, the selection signal in the storage capacitor $C_s$ is set to HI. In response thereto, the switching transistor $S_1$ (NMOS) is switched to an on state, and the switching transistor $S_2$ (PMOS) is switched to an off state. With this, the drive voltage and the drive current that have flown through the current drive transistor T are input to the light emitting element D1_k. Thus, the light emitting element D1_k emits light.

Figure 16:
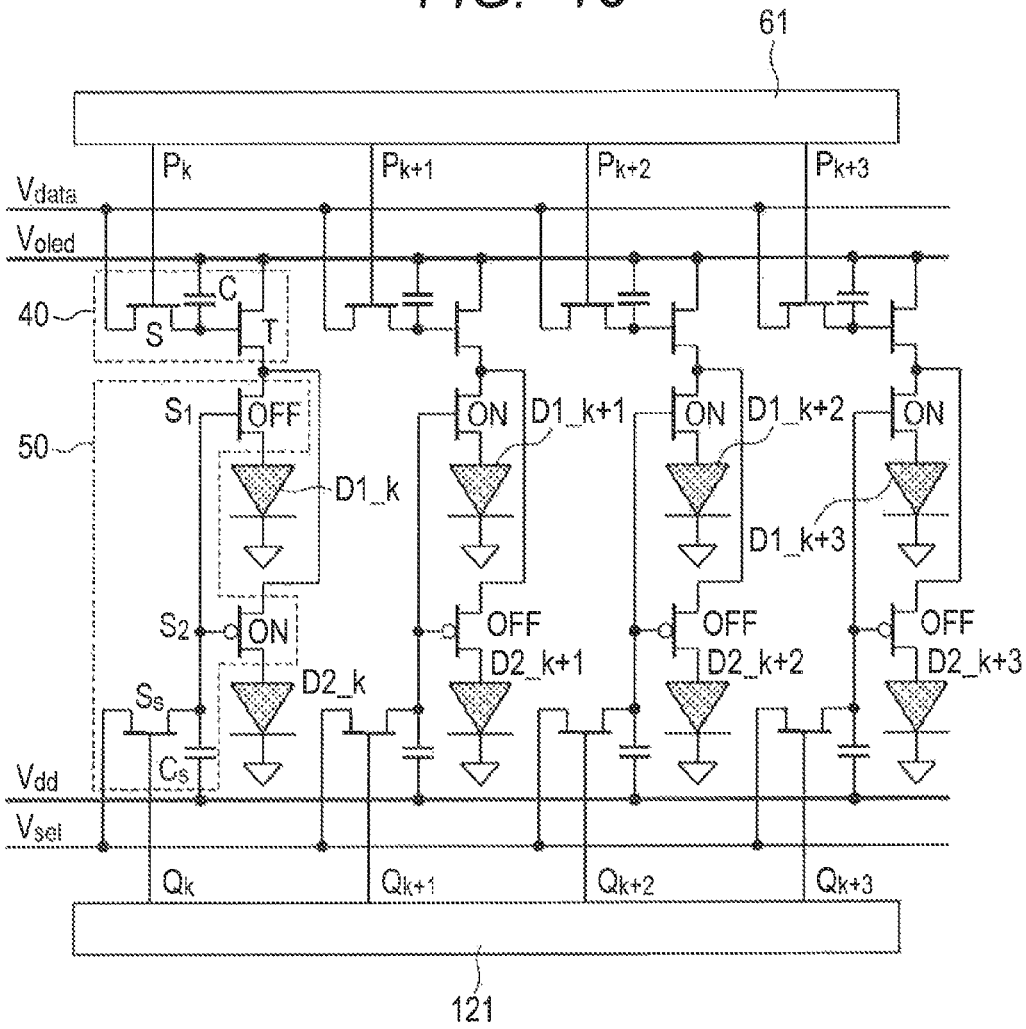
FIG. 16 is an explanatory diagram of a specific measure against a case where a trouble has occurred in particular one of the light emitting elements of a light emitting element array having the drive circuit of FIG. 15.

FIG. 16 is an explanatory diagram of a specific measure against a case where a trouble has occurred in particular one of the light emitting elements of a light emitting element array having the drive circuit of FIG. 15. In this embodiment, in order to cause the light emitting element D2_k to emit light, for example, in a case where the light emitting element D1_k becomes defective, the selection signal in the storage capacitor $C_s$ is set to LOW. In response thereto, the switching transistor $S_1$ (NMOS) is switched to an off state, and the switching transistor $S_2$ (PMOS) is switched to an on state. With this, the drive voltage and the drive current that have flown through the current drive transistor T are input to the light emitting element D2_k. Thus, the light emitting element D2_k emits light.

As described above, the drive circuit of the printing apparatus according to this embodiment selects the following mode (i) or (ii) based on the selection information ($V_{sel}$) stored in the storage capacitor $C_s$ of the selection circuit 50.

(i) Turn on the switching transistor $S_1$ and turn off the switching transistor $S_2$ so that the electric current output from the pixel drive circuit is supplied only to the light emitting element D1_k.

(ii) Turn off the switching transistor $S_1$ and turn on the switching transistor $S_2$ so that the electric current output from the pixel drive circuit is supplied only to the light emitting element D2_k.

Further, in this embodiment, the light emitting element D1_k or the light emitting element D2_k is caused to emit light through scanning with the first scanning line and scanning with the second scanning line. Further, in this embodiment, the signal to be introduced to the pixel drive circuit through the scanning with the first scanning line and the signal to be introduced to the selection circuit through the scanning with the second scanning line are different from each other. However, the present invention is not limited thereto.

Figure 17:
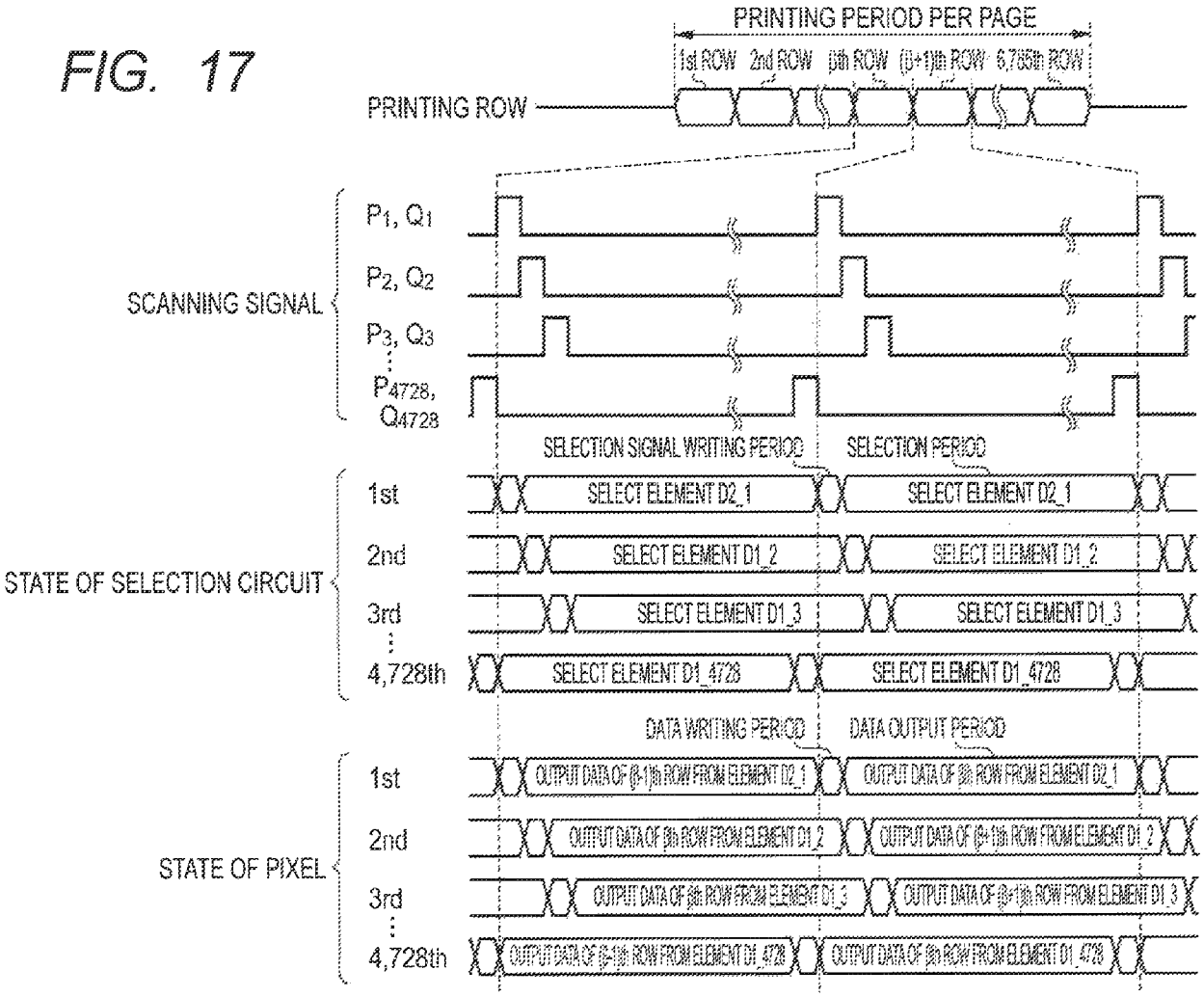
FIG. 17 is a drive timing chart of the light emitting element array of the printing apparatus according to Embodiment 4.
Figure 18:
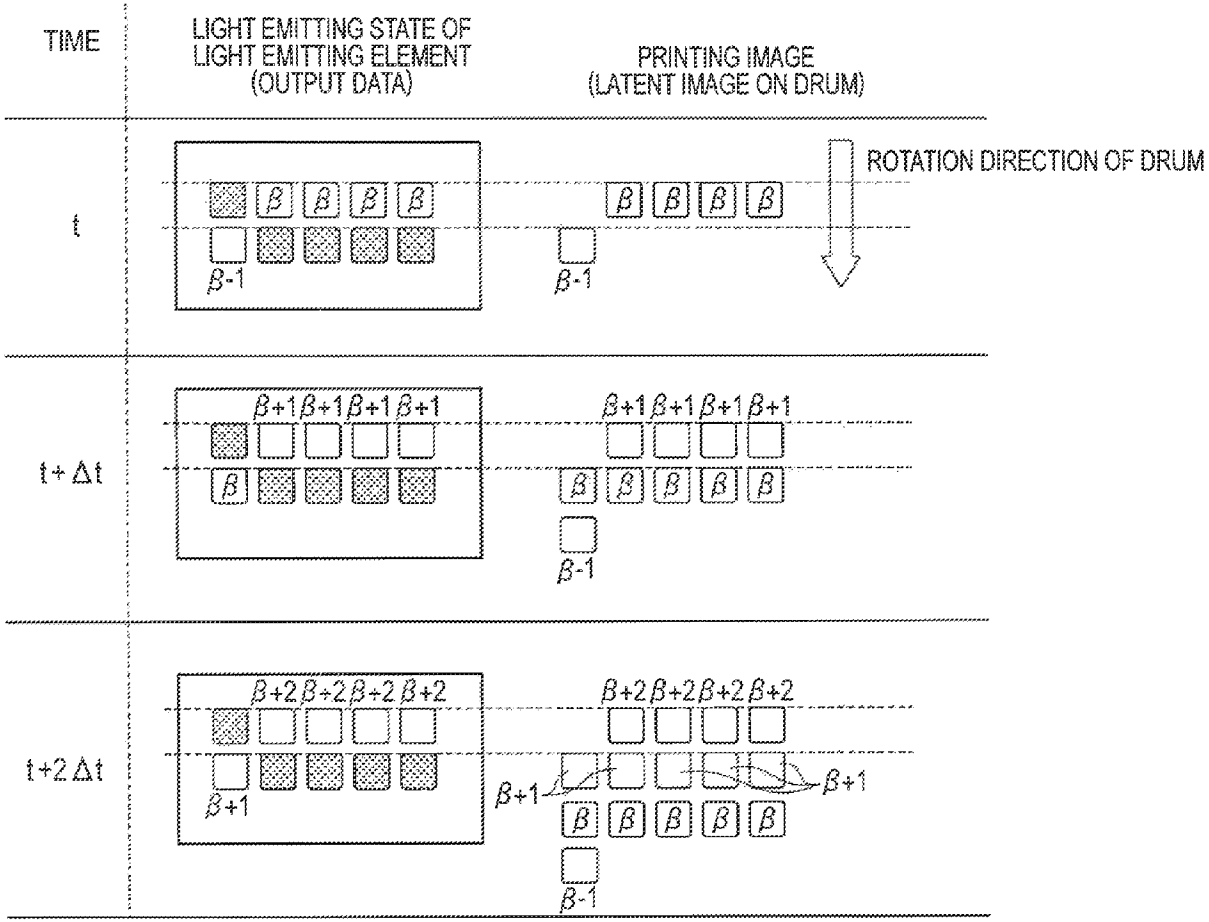
FIG. 18 is a chart showing relationships between light emitting states of the light emitting elements (organic EL elements) and printing images at predetermined timings.

Note that, it is preferred that the scanning with the scanning circuit 121 (scanning with the second scanning line), which is performed at the time of activating the selection circuit 50, be performed in synchronization with the scanning with the scanning circuit 61 (scanning with the first scanning line). FIG. 17 is a drive timing chart of the light emitting element array of the printing apparatus according to Embodiment 4. Note that, in the drive timing chart of FIG. 17, of the light emitting elements arranged in the two rows in the light emitting element array 21, the light emitting element D2_1 in the second row emits light in the first column, and light emitting elements in the first row emit light in other columns. Further, FIG. 18 is a chart showing relationships between light emitting states of the light emitting elements (organic EL elements) and printing images at predetermined timings. Note that, as shown in FIG. 18, the light emitting states of the light emitting elements reflect output data of predetermined light emitting elements, and printing images reflect latent images to be formed on the photosensitive drum.

In this case, in pixels in the first column, a latent image is formed at a position shifted by an amount of a single row (42.3 μm) relative to pixels in other columns (FIG. 18). In this embodiment, image information that was supposed to be output from the light emitting element D1_1 of a pixel in the first column and the first row is temporarily stored in the image information memory 53. Then, in accordance with the position information in the position information memory 52 and image information in the image information memory 53, image information items only of positions in the first column of the light emitting element array 21 are output while being sequentially shifted. Specifically, at a time point of outputting an image of a βth row in the first row (time point t), the light emitting element D2_1 outputs an image of a (β−1)th row with reference to an image information item of the (β−1)th row (FIG. 17).

By the way, the operation of setting the selection signal in the storage capacitor $C_s$, which is illustrated in FIG. 16, is performed at the time of using the printing apparatus including the light emitting element array 21. For example, in an inspection step after manufacture of the light emitting element array 21, lighting tests of light emitting elements of pixels in a predetermined row of the light emitting element array 21 (for example, first row) are conducted. In a case where results of the tests have proved that none of the light emitting elements of the pixels in the predetermined row (first row) is defective, the light emitting element array 21 is shipped as it is as a part of a product together with other members. Meanwhile, when there is any defective element in the predetermined row (first row), position information of a pixel having the defective element is stored in the position information memory 52. Then, based on the position information, the selection signal of the storage capacitor $C_s$ is changed. Specifically, the selection signal of the storage capacitor $C_s$ is changed from HI to LOW. When the light emitting element D1_k is defective, other light emitting elements in the same column, for example, the light emitting element D2_k is caused to emit light. Note that, when both the light emitting elements D1_k and D2_k are defective, the light emitting element array 21 is disposed of as a defective product.

In the printing apparatus using the light emitting element array as an exposure head, by controlling the circuits and output as described above, print image quality can be maintained even when the light emitting elements of the light emitting element array become defective. Note that, in this embodiment, unlike Embodiments 1 to 3, the wiring disconnection operation needs not be performed, and hence the manufacturing step and the inspection step can be simplified.

Note that, in the light emitting element array of the printing apparatus, even when none of the light emitting elements of the pixels in the first row is defective at the time of shipping, the light emitting elements are deteriorated through use of the printing apparatus. Specifically, as a result of operating the printing apparatus over a long period of time after the shipping, some of the light emitting elements of the pixels in the first row of the light emitting element array may be deteriorated to cause local luminance deterioration. In this case, streak-like image defects appear on printed materials. When such image defects occur, information of the luminance deterioration of a pixel that causes the image defects (for example, pixel including the light emitting element D1_k) is detected, and stored in the position information memory 52. At this time, in order to detect the information of the luminance deterioration of the light emitting element D1_k, a predetermined pattern is printed. Then, a printed material obtained through the printing in this pattern is read with a scanner. In this way, the luminance deterioration information is extracted.

Based on the luminance deterioration information, any of the multiple light emitting elements provided in a predetermined column is driven. As an example of a specific method of selectively driving the light emitting elements, there may be given a conversion of the selection signal of the storage capacitor $C_s$, which is performed as appropriate at the time of the inspection step before shipping. However, the present invention is not limited to this method. For example, as described in Embodiments 1 to 3, the (physical) disconnection of some of the wiring lines of the drive circuit may be employed.

By controlling the circuits and output as described above, print image quality can be maintained as in Embodiment 1 even when the light emitting elements of the light emitting element array become defective.

Note that, in the example describe in this embodiment, the luminance deterioration information of the pixels in the first row is detected by reading the printed material, but the present invention is not limited thereto. There may be employed a method of directly detecting luminance of each of the pixels in the first row. Alternatively, there may be employed a method of counting a total lighting time period of each of the pixels and specifying a deteriorated pixel based on the count information.

Embodiment 5

Figure 19:
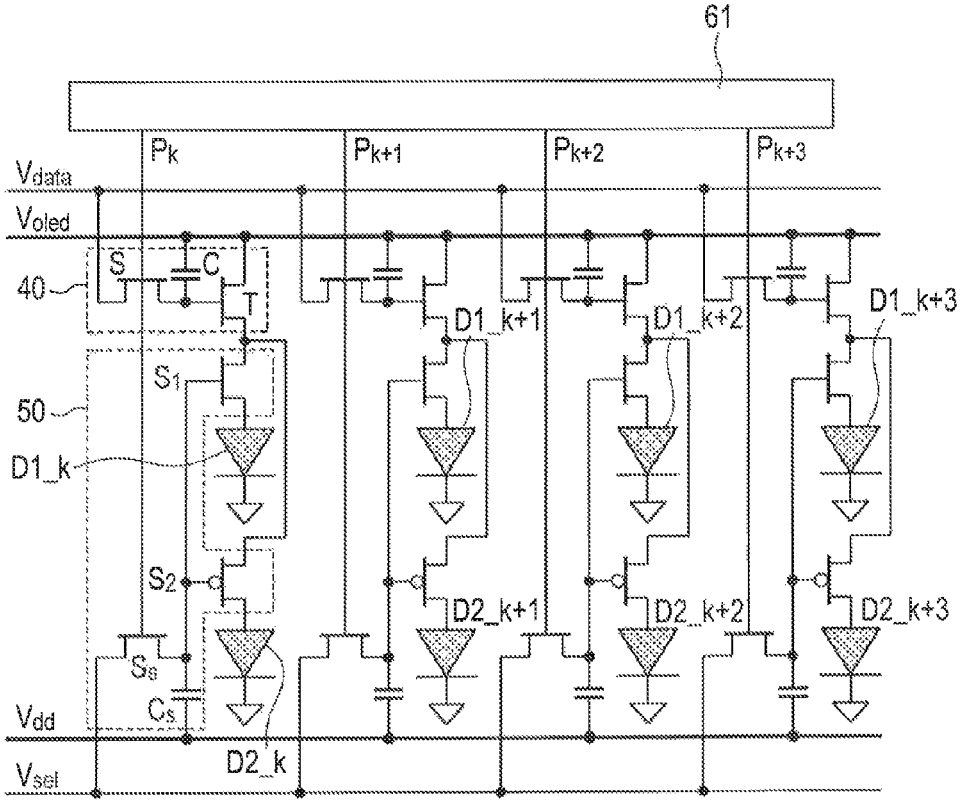
FIG. 19 is a circuit diagram of a printing apparatus according to Embodiment 5 of the present invention.

FIG. 19 is a circuit diagram of a printing apparatus according to this embodiment (Embodiment 5) of the present invention. In this embodiment, the drive circuit for the light emitting element array is partially different from those in Embodiments 1 and 4. In the following, this embodiment is described with a focus on the difference between this embodiment and Embodiment 4.

The drive circuit illustrated in FIG. 19 is the same as the drive circuit of FIG. 15 except that a common scanning signal (scanning signal ($P_k$) to be sent from the scanning circuit 61) is sent to the switching transistor S of the pixel drive circuit and the switching transistor $S_s$ of the selection circuit unlike the drive circuit of FIG. 15. In other words, in this embodiment, the first scanning lines and the second scanning lines are connected to the same scanning circuit.

As illustrated in FIG. 19, depending on design of the pixel drive circuit and the selection circuit, the output from the scanning circuit 61 may be shared with the switching transistor S of the pixel drive circuit and the switching transistor $S_s$ of the selection circuit. Further, in this embodiment, through the scanning with the first scanning lines, the storage capacitor (C) of the pixel drive circuit 40 and the storage capacitor ($C_s$) of the selection circuit 50 can be rewritten simultaneously with each other.

Embodiment 6

Figure 20:
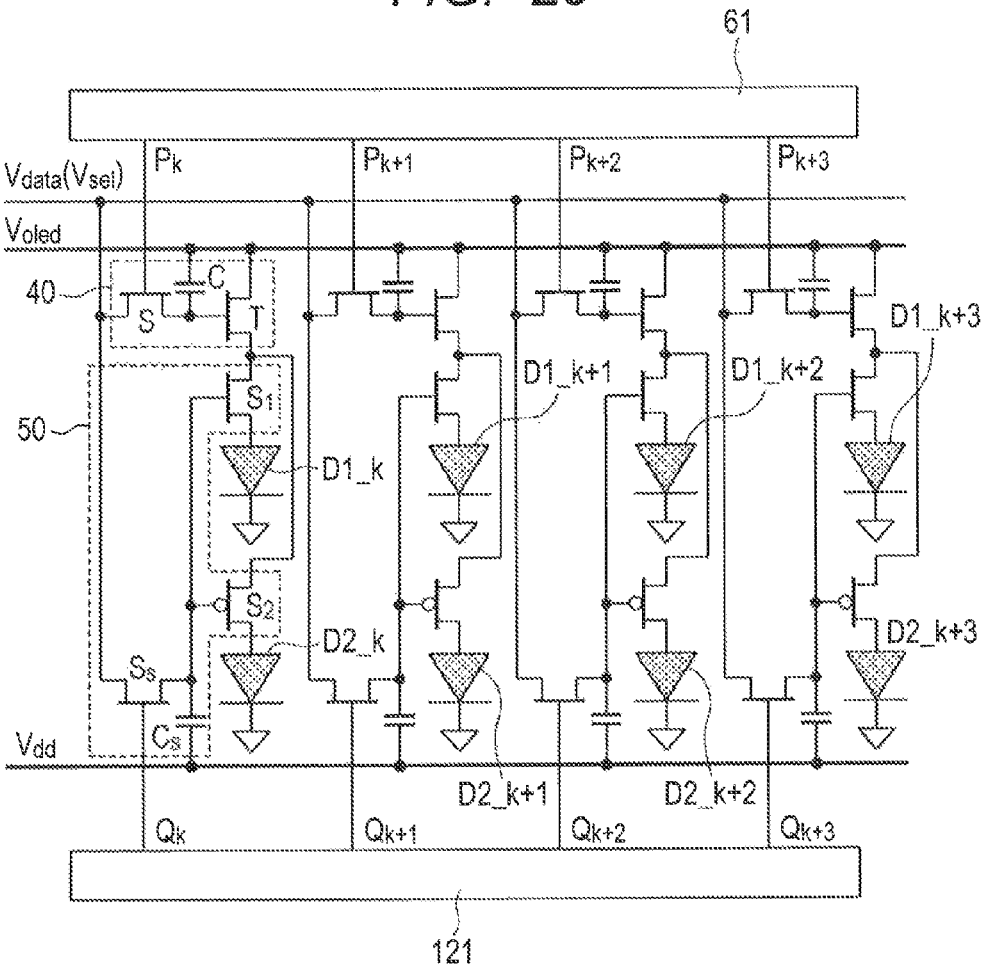
FIG. 20 is a circuit diagram of a printing apparatus according to Embodiment 6 of the present invention.

FIG. 20 is a circuit diagram of a printing apparatus according to this embodiment (Embodiment 6) of the present invention. In this embodiment, the drive circuit for the light emitting element array is partially different from those in Embodiments 1 and 4. In the following, this embodiment is described with a focus on the difference between this embodiment and Embodiment 4.

FIG. 20 is a circuit diagram of a drive circuit for a light emitting element array of a printing apparatus according to Embodiment 6 of the present invention. The drive circuit of FIG. 20 is the same as the drive circuit of FIG. 15 except that a signal line $V_{data}$ for inputting the image signal and a signal line $V_{sel}$ for inputting the selection signal are used in common with each other unlike the drive circuit of FIG. 15. Thus, the signal line for introducing a signal to the pixel drive circuit through scanning with the first scanning line and the signal line for introducing a signal to the selection circuit through scanning with the second scanning line are the same as each other. Further, the pixel drive circuit in this embodiment is operated in the same way as that in Embodiment 4. In addition, also in this embodiment, the pixel drive circuit and the selection circuit are activated in the same cycle as in Embodiment 4.

Figure 21:
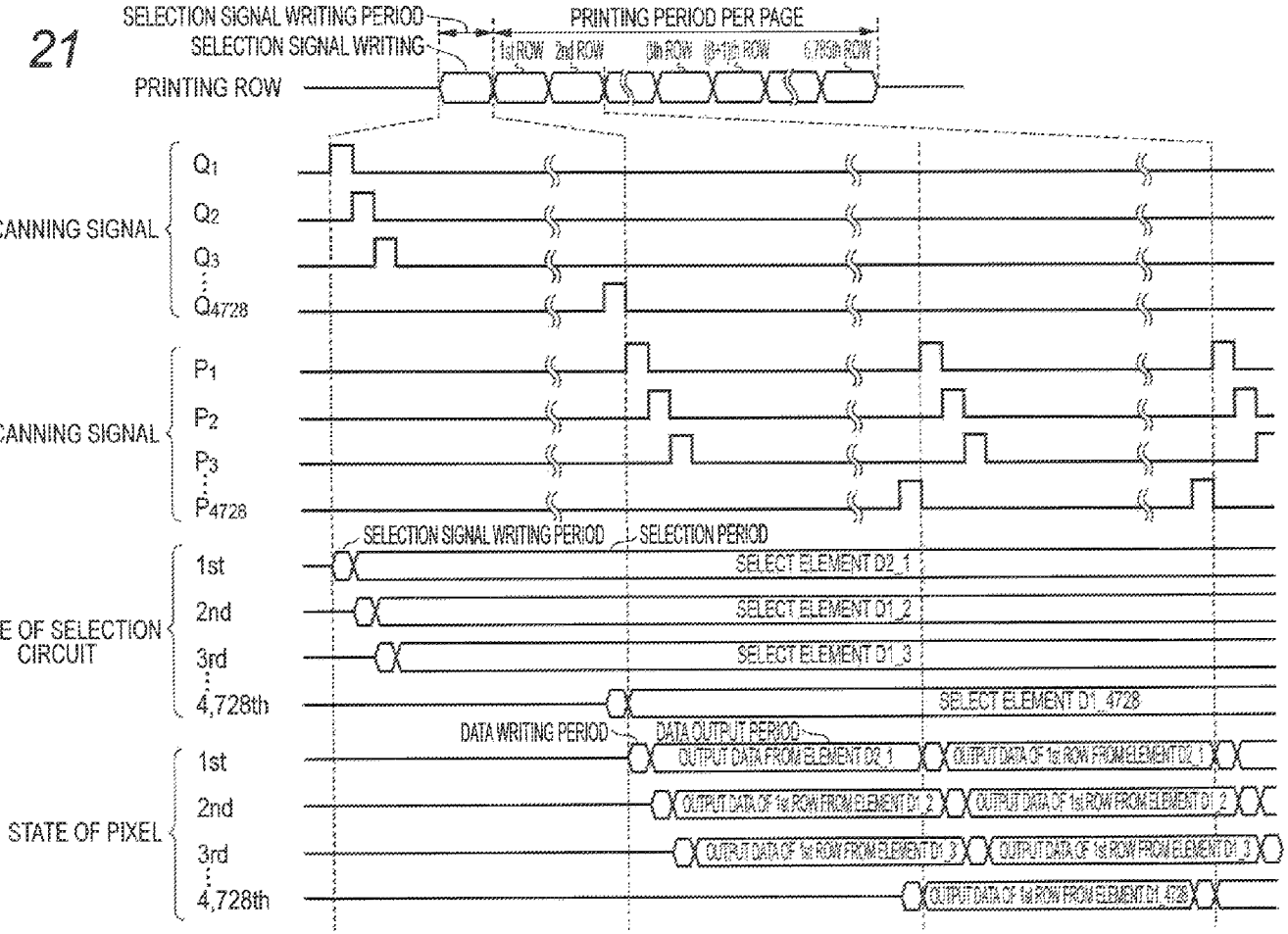
FIG. 21 is a drive timing chart of the light emitting element array of the printing apparatus according to Embodiment 6.

FIG. 21 is a drive timing chart of the light emitting element array of the printing apparatus according to this embodiment. Note that, in the drive timing chart of FIG. 21, of the light emitting elements arranged in the two rows in the light emitting element array 21, the light emitting element D2__1 in the second row emits light in the first column, and light emitting elements in the first row emit light in other columns. As shown in FIG. 21, in this embodiment, writing to the selection circuits can be completed immediately before a start of printing of one page. In other words, printing of a page can be started immediately after the scanning with the second scanning lines is completed.

Note that, in this embodiment, a memory function of the selection circuit is exerted by a simple configuration of the single transistor ($S_s$) and the single storage capacitor ($C_s$), but the present invention is not limited to this configuration. For example, an SRAM may be employed as the memory.

The drive circuit used in this embodiment is simpler in design than the drive circuit in Embodiment 4. This is because the signal line $V_{sel}$ can be omitted.

According to the present invention, the printing apparatus that maintains print image quality and has a high yield can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-144677, filed Jul. 10, 2013, which is hereby incorporated by reference herein in its entirety.

What is claimed is:

1. A printing apparatus, comprising:

a photosensitive drum;

a substrate comprising multiple formable regions in each of which corresponding one of multiple light emitting elements is formable, the multiple light emitting elements being formed in at least two of the multiple formable regions; and a lens array for imaging light beams from the multiple light emitting elements on the photosensitive drum, wherein the substrate is arranged in a manner that a longitudinal direction of the substrate is parallel to a rotary shaft of the photosensitive drum, wherein the substrate comprises m formable region rows, where m is an integer number equal to or greater than 2, each of the m formable region rows comprising n formable regions, where n is an integer number equal to or greater than 1, arranged in a line along the longitudinal direction of the substrate, and wherein one of the multiple light emitting elements formed in any one of m formable regions that are located in a predetermined column of the m formable region rows is turned on;

wherein the multiple light emitting elements comprise m light emitting elements D1_k, D2_k, . . . Dj_k, . . . Dm_k that are provided in regions in a k-th column of the multiple formable regions, where $2 \leq j \leq m$, j is an integer number, k is an integer number, and $1 \leq k \leq n$, wherein the substrate comprises a single pixel drive circuit for outputting drive current in response to a scanning signal, the single pixel drive circuit being provided to a group of the m light emitting elements in the k-th column, wherein the light emitting element Dj_k is connected to an output of the single pixel drive circuit via a switching transistor $S_j$, and wherein one of the following states is established:

a state in which the light emitting element D1_k is connected to the output of the single pixel drive circuit with a wiring $L_d$ while a first voltage line for turning off the switching transistor $S_j$ and a gate electrode of the switching transistor $S_j$ are connected to each other with a wiring $L_{gj}$; and a state in which the light emitting element D1_k is out of connection to the output of the single pixel drive circuit with the wiring $L_d$ while a second voltage line for turning on the switching transistor $S_j$ and the gate electrode of the switching transistor $S_j$ are connected to each other via a resistor $R_j$.

2. The printing apparatus according to claim 1, wherein the multiple light emitting elements are each provided to occupy an entire corresponding one of the multiple formable regions.

3. The printing apparatus according to claim 1, wherein the multiple light emitting elements are each provided to occupy a part of corresponding one of the multiple formable regions, and wherein the multiple light emitting elements are formed into the same shape, and multiple light emitting elements arranged in the same column have centers that are aligned with each other.

4. The printing apparatus according to claim 1, wherein the multiple light emitting elements comprise m light emitting elements D1_k, D2_k, . . . Dj_k, . . . Dm_k that are provided in regions in a k-th column of the multiple formable regions, where $2 \leq j \leq m$, j is an integer number, k is an integer number, and $1 \leq k \leq n$, wherein the substrate comprises m drive transistors T1_k, T2_k, . . . Tj_k, . . . Tm_k for controlling output of drive current in response to scanning signals, the m drive transistors being provided respectively to the m light emitting elements in the k-th column, wherein the light emitting element Dj_k is connected to an output of the drive transistor Tj_k via a switching transistor $S_j$, and wherein one of the following states is established:

a state in which the light emitting element D1_k is connected to an output of the drive transistor T1_k with a wiring $L_d$ while a first voltage line for turning off the switching transistor $S_j$ and a gate electrode of the switching transistor $S_j$ are connected to each other with a wiring $L_{gj}$; and a state in which the light emitting element D1_k is out of connection to the output of the drive transistor T1_k with the wiring $L_d$ while a second voltage line for turning on the switching transistor $S_j$ and the gate electrode of the switching transistor $S_j$ are connected to each other via a resistor $R_j$.

5. The printing apparatus according to claim 1, wherein, in a k-th column, where k is an integer number and $1 \leq k \leq n$, as the predetermined column of the n formable regions, the substrate comprises:

a single pixel drive circuit for outputting drive current in response to a scanning signal;

a light emitting element D1_k;

a light emitting element D2_k; and a selection circuit for causing one of the light emitting element D1_k and the light emitting element D2_k to emit light, wherein the selection circuit comprises a storage capacitor for storing a selection information item of the light emitting element D1_k and a selection information item of the light emitting element D2_k, wherein the light emitting element D1_k is connected to an output of the single pixel drive circuit via a switching transistor $S_1$, wherein the light emitting element D2_k is connected to the output of the single pixel drive circuit via a switching transistor $S_2$, and wherein a gate electrode of the switching transistor $S_1$ and a gate electrode of the switching transistor $S_2$ are connected to the storage capacitor of the selection circuit.

6. The printing apparatus according to claim 5, wherein the printing apparatus selects one of the following state (i) and the following state (ii) based on the selection information items stored in the storage capacitor of the selection circuit:

(i) a state in which the switching transistor $S_1$ is turned on and the switching transistor $S_2$ is turned off so that the drive current output from the single pixel drive circuit is supplied only to the light emitting element D1_k; and (ii) a state in which the switching transistor $S_1$ is turned off and the switching transistor $S_2$ is turned on so that the drive current output from the single pixel drive circuit is supplied only to the light emitting element D2_k.

7. The printing apparatus according to claim 6, wherein the substrate comprises:

a first scanning line connected to a gate electrode of a selection transistor of the single pixel drive circuit; and a second scanning line connected to a switching transistor of the selection circuit, the switching transistor of the selection circuit being configured to drive one of the switching transistor $S_1$ and the switching transistor $S_2$, wherein the first scanning line and the second scanning line are connected respectively to different scanning circuits, wherein one of the light emitting element D1_k and the light emitting element D2_k is caused to emit light through scanning with the first scanning line and scanning with second scanning line, wherein a signal to be introduced to the single pixel drive circuit through the scanning with the first scanning line and a signal to be introduced to the selection circuit through the scanning with the second scanning line are different from each other, and wherein the scanning with the first scanning line and the scanning with the second scanning line are synchronized with each other.

8. The printing apparatus according to claim 6, wherein the substrate comprises:

a first scanning line connected to a gate electrode of a selection transistor of the single pixel drive circuit; and a second scanning line connected to a switching transistor of the selection circuit, the switching transistor of the selection circuit being configured to drive one of the switching transistor $S_1$ and the switching transistor $S_2$, wherein the first scanning line and the second scanning line are connected to the same scanning circuit, wherein one of the light emitting element D1_k and the light emitting element D2_k is caused to emit light through scanning with the first scanning line and scanning with second scanning line, and wherein a storage capacitor of the single pixel drive circuit and the storage capacitor of the selection circuit are rewritten simultaneously with each other through the scanning with the first scanning line.

9. The printing apparatus according to claim 6, wherein the substrate comprises:

a first scanning line connected to a gate electrode of a selection transistor of the single pixel drive circuit; and a second scanning line connected to a switching transistor of the selection circuit, the switching transistor of the selection circuit being configured to drive one of the switching transistor $S_1$ and the switching transistor $S_2$, wherein the first scanning line and the second scanning line are connected respectively to different scanning circuits, wherein one of the light emitting element D1_k and the light emitting element D2_k is caused to emit light through scanning with the first scanning line and scanning with second scanning line, wherein a signal line for introducing a signal to the single pixel drive circuit through the scanning with the first scanning line and a signal line for introducing a signal to the selection circuit through the scanning with the second scanning line are the same as each other, and wherein the scanning with the first scanning line and the scanning with the second scanning line are synchronized with each other.

10. The printing apparatus according to claim 1, wherein, in a case where the light emitting element D1_k is defective, only one of the light emitting element D2_k and the light emitting element Dj_k is turned on.

11. The printing apparatus according to claim 1, wherein, depending on a degree of luminance deterioration of the light emitting element D1_k, a light emitting element to be turned on is switched from the light emitting element D1_k to the light emitting element D2_k.

12. The printing apparatus according to claim 1, further comprising:

a unit configured to sequentially send printing image information items of a first row to a βth row, where β is an integer number equal to or greater than 1, to the substrate in synchronization with rotation of the photosensitive drum;

a unit configured to selectively turn on only the light emitting element Dj_k among multiple formable regions arranged in a short side direction in a k-th column of the n formable regions arranged in the longitudinal direction based on corresponding one of the sent printing image information items; and a unit configured to send a printing image information item of a (α−j+1)th row to the light emitting element Dj_k at a time of sending a printing image information item of an αth row, where α is an integer number equal to or greater than 1 and $1 \leq \alpha \leq \beta$ to the light emitting elements D1__1 to D1_n.

13. The printing apparatus according to claim 1, further comprising a scanner for reading a printed material, wherein a predetermined pattern is printed on the printed material, wherein the predetermined pattern is read with the scanner so that luminance deterioration information is detected, and wherein which of the multiple light emitting elements is turned on is selected based on the luminance deterioration information.

* * * * *